US008158914B2

(12) United States Patent
Wnek et al.

(10) Patent No.: US 8,158,914 B2
(45) **Date of Patent: *Apr. 17, 2012**

(54) MICROWAVE ENERGY INTERACTIVE HEATING SHEET

(75) Inventors: Patrick H. Wnek, Sherwood, WI (US); Lorin R. Cole, Larsen, WI (US); Scott W. Middleton, Oshkosh, WI (US); Richard G. Robison, Gray, TN (US)

(73) Assignee: Graphic Packaging International, Inc., Marietta, GA (US)

( * ) Notice: Subject to any disclaimer, the term of this patent is extended or adjusted under 35 U.S.C. 154(b) by 1359 days.

This patent is subject to a terminal disclaimer.

(21) Appl. No.: 11/801,646

(22) Filed: May 10, 2007

(65) Prior Publication Data

US 2007/0251943 A1 Nov. 1, 2007

Related U.S. Application Data

(63) Continuation-in-part of application No. 11/314,851, filed on Dec. 21, 2005, now Pat. No. 7,351,942, which is a continuation of application No. 10/501,003, filed as application No. PCT/US03/03779 on Feb. 7, 2003, now Pat. No. 7,019,271, said application No. 11/801,646 is a continuation-in-part of application No. 11/054,633, filed on Feb. 9, 2005, now Pat. No. 7,365,292.

(60) Provisional application No. 60/355,149, filed on Feb. 8, 2002, provisional application No. 60/543,364, filed on Feb. 9, 2004, provisional application No. 60/800,073, filed on May 12, 2006.

(51) Int. Cl.
*H05B 6/80* (2006.01)

(52) U.S. Cl. ..... 219/730; 219/725; 219/728; 426/107

(58) Field of Classification Search ..... 219/725–735, 219/759, 782; 426/107, 109, 118, 234, 241, 426/243; 99/DIG. 14

See application file for complete search history.

(56) References Cited

U.S. PATENT DOCUMENTS

| | | | | |
|---|---|---|---|---|
| 4,775,771 | A | 10/1988 | Pawlowski | |
| 4,865,921 | A | 9/1989 | Hollenberg | |
| 4,890,439 | A | 1/1990 | Smart | |
| 4,936,935 | A | 6/1990 | Beckett | |
| 4,963,424 | A | 10/1990 | Beckett | |
| 5,039,364 | A | 8/1991 | Beckett et al. | |
| 5,117,078 | A | 5/1992 | Beckett | |
| 5,164,562 | A * | 11/1992 | Huffman et al. | 219/730 |
| 5,213,902 | A | 5/1993 | Beckett | |

(Continued)

FOREIGN PATENT DOCUMENTS

JP 2000 043953 A 2/2000

(Continued)

OTHER PUBLICATIONS

International Search Report—PCT/US2007/011348.

(Continued)

*Primary Examiner* — Quang Van

(74) *Attorney, Agent, or Firm* — Womble Carlyle Sandridge & Rice, LLP

(57) ABSTRACT

A microwave energy interactive heating sheet includes at least two susceptor layers and a plurality of expandable insulating cells. At least some of the expandable insulating cells inflate when exposed to microwave energy.

25 Claims, 15 Drawing Sheets

U.S. PATENT DOCUMENTS

| | | | | |
|---|---|---|---|---|
| 5,221,419 | A | 6/1993 | Beckett | |
| 5,260,537 | A | 11/1993 | Beckett | |
| 5,266,386 | A | 11/1993 | Beckett | |
| 5,317,118 | A * | 5/1994 | Brandberg et al. | 219/727 |
| RE34,683 | E | 8/1994 | Maynard | |
| 5,340,436 | A | 8/1994 | Beckett | |
| 5,354,973 | A | 10/1994 | Beckett | |
| 5,410,135 | A | 4/1995 | Pollart | |
| 5,424,517 | A | 6/1995 | Habeger | |
| 5,519,195 | A | 5/1996 | Keefer | |
| 5,628,921 | A | 5/1997 | Beckett | |
| 5,672,407 | A | 9/1997 | Beckett | |
| 5,759,422 | A | 6/1998 | Schmelzer | |
| 5,800,724 | A | 9/1998 | Habeger | |
| 5,921,681 | A | 7/1999 | Money | |
| 6,016,950 | A | 1/2000 | Money | |
| 6,114,679 | A | 9/2000 | Lai | |
| 6,150,646 | A | 11/2000 | Lai | |
| 6,204,492 | B1 | 3/2001 | Zeng | |
| 6,251,451 | B1 | 6/2001 | Zeng | |
| 6,335,042 | B1 | 1/2002 | Money | |
| 6,414,290 | B1 | 7/2002 | Cole | |
| 6,431,365 | B1 | 8/2002 | Money | |
| 6,433,322 | B2 | 8/2002 | Zeng | |
| 6,455,827 | B2 | 9/2002 | Zeng | |
| 6,552,315 | B2 | 4/2003 | Zeng | |
| 6,677,563 | B2 | 1/2004 | Lai | |
| 6,717,121 | B2 | 4/2004 | Zeng | |
| 6,765,182 | B2 | 7/2004 | Cole | |
| 7,019,271 | B2 | 3/2006 | Wnek | |
| 7,361,872 | B2 * | 4/2008 | Cole | 219/725 |
| 2005/0205565 | A1 | 9/2005 | Cole et al. | |
| 2006/0049190 | A1 | 3/2006 | Middleton et al. | |
| 2006/0113300 | A1 | 6/2006 | Wnek | |
| 2006/0278521 | A1 | 12/2006 | Stowell | |
| 2007/0039951 | A1 | 2/2007 | Cole | |

FOREIGN PATENT DOCUMENTS

| | | |
|---|---|---|
| WO | WO 03/066435 A2 | 8/2003 |

OTHER PUBLICATIONS

Written Opinion—PCT/US2007/011348.

* cited by examiner

MICROWAVE ENERGY INTERACTIVE HEATING SHEET

CROSS-REFERENCE TO RELATED APPLICATIONS

This application is a continuation-in-part of U.S. patent application Ser. No. 11/314,851, filed Dec. 21, 2005, now U.S. Pat. No. 7,351,942, which is a continuation of U.S. patent application Ser. No. 10/501,003, filed Mar. 7, 2005, now U.S. Pat. No. 7,019,271, which is a national stage entry under 35 U.S.C. §363 of PCT/US03/03779, filed Feb. 7, 2003, which claims the benefit of U.S. Provisional Application No. 60/355,149, filed Feb. 8, 2002, each of which is hereby incorporated by reference in its entirety as though fully set forth herein, and this application is a continuation-in-part of U.S. patent application Ser. No. 11/054,633, filed Feb. 9, 2005, now U.S. Pat. No. 7,365,292, which claims the benefit of U.S. Provisional Application No. 60/543,364, filed Feb. 9, 2004, both of which are hereby incorporated by reference in its entirety as though fully set forth herein, and this application also claims the benefit of U.S. Provisional Application No. 60/800,073, filed May 12, 2006, which is incorporated by reference herein in its entirety as though set forth fully herein.

TECHNICAL FIELD

The present invention relates to various materials, packages, constructs, and systems for heating or cooking a microwavable food item. In particular, the invention relates to various materials, packages, constructs, and systems for heating, browning, and/or crisping a food item in a microwave oven.

BACKGROUND

Microwave ovens provide a convenient means for heating a variety of food items, including dough-based products such as pizzas and pies. However, microwave ovens tend to cook such items unevenly and are unable to achieve the desired balance of thorough heating and a browned, crisp crust. As such, there is a continuing need for improved materials and packages that provide the desired degree of heating, browning, and/or crisping of food items in a microwave oven.

SUMMARY

The present invention is directed generally to various materials, sheets, constructs, packages, and systems that can provide improved heating, browning, and/or crisping of a dough-based food item in a microwave oven.

In one aspect, a material comprises a layered structure that at least partially insulates a food item from its environment.

In another aspect, a material comprises a layered structure that at least partially insulates a food item from its environment and that features improved browning and crisping thereof.

In yet another aspect, a packaging system includes a microwave interactive heating sheet that at least partially insulates a food item from its environment and that promotes browning and crisping of a food item heated thereon.

In another aspect, a microwave energy interactive heating sheet comprises at least two susceptor layers and a plurality of expandable insulating cells. At least some of the expandable insulating cells inflate when the microwave energy interactive heating sheet is exposed to microwave energy. Prior to exposure to microwave energy, the microwave energy interactive heating sheet may be substantially planar. After sufficient exposure to microwave energy, the microwave energy interactive heating sheet has a multi-dimensional, lofted shape.

In one variation of this aspect, the microwave energy interactive heating sheet includes a first surface intended to be contacted by a food item desired to be browned and/or crisped, and at least one of the susceptor layers is proximate the first surface. In another variation, the susceptor layers include a first susceptor layer and a second susceptor layer, and the microwave energy interactive heating sheet further comprises, in a layered configuration: a first polymer film layer, the first susceptor layer, a first moisture-containing layer, a patterned adhesive layer, a second moisture-containing layer, the second susceptor layer, and a second polymer film layer. The patterned adhesive layer defines the plurality of expandable insulating cells between the first moisture-containing layer and the second moisture-containing layer.

In another aspect, a microwave energy interactive heating sheet comprises a first ply of microwave energy interactive insulating material and a second ply of microwave energy interactive insulating material in a layered configuration. The first ply of microwave energy interactive insulating material includes a layer of microwave energy interactive material that converts microwave energy to thermal energy, a moisture-containing layer at least partially joined to the layer of microwave energy interactive material, and a polymer film layer joined to the moisture-containing layer in a predetermined pattern, thereby defining a plurality of expandable insulating cells between the moisture-containing layer and the polymer film layer.

In one variation, the first and second plies of microwave energy interactive insulating material are at least partially joined. In another variation, the first and second plies of microwave energy interactive insulating material are at least partially joined along respective peripheral edges of the first ply and second ply to define an interior space for receiving a food item.

In yet another variation, the heating sheet has a surface intended to be in contact with a food item, where the layer of microwave energy interactive material that converts microwave energy to thermal energy is proximate the first surface.

In still another variation, the microwave energy interactive heating sheet is combined with a dimensionally stable construct, where the dimensionally stable construct includes a first surface and a second surface opposite the first surface, the first surface is intended to be in contact with a food item, and the second surface is intended to be in contact with the microwave energy interactive heating sheet.

In yet another variation, the second ply of microwave energy interactive insulating material includes a layer of microwave energy interactive material that converts microwave energy to thermal energy, a moisture-containing layer at least partially joined to the layer of microwave energy interactive material, and a polymer film layer joined to the moisture-containing layer in a predetermined pattern, thereby defining a plurality of expandable insulating cells between the moisture-containing layer and the polymer film layer.

In another aspect, a microwave energy interactive heating sheet comprises at least two plies of a microwave energy interactive insulating material arranged in a superposed, layered configuration. Each ply of microwave energy interactive insulating material includes a susceptor film comprising a microwave energy interactive material supported on a first polymer film layer, a moisture-containing layer superposed with the microwave energy interactive material, and a second polymer film layer joined to the moisture-containing layer in a predetermined pattern, thereby defining a plurality of expandable insulating cells between the moisture-containing layer and the second polymer film layer. At least some of the expandable insulating cells inflate when the microwave energy interactive heating sheet is exposed to microwave energy.

If desired, the plies may be at least partially joined to one another. In one example, the plies of microwave energy interactive insulating material include a first ply and a second ply, and the first ply and the second ply are at least partially joined along respective peripheral edges of the first ply and the second ply to define a cavity for receiving a food item.

In one variation, the microwave energy interactive heating sheet has a surface intended to be in contact with a food item, and the susceptor film layer in one of the plies is proximate the first surface.

In another variation, the microwave energy interactive heating sheet is combined with a dimensionally stable construct, where the dimensionally stable construct includes a first surface and a second surface opposite the first surface, the first surface is intended to be in contact with a food item, and the second surface is intended to be in contact with the microwave energy interactive heating sheet.

In yet another variation, the microwave energy interactive heating sheet is combined with a dimensionally stable construct in a packaging arrangement in which the microwave energy interactive heating sheet overlies the food item, and the food item overlies the dimensionally stable construct. If desired, information about the food item may be printed on the microwave energy interactive heating sheet. Further, if desired, the microwave energy interactive heating sheet may be folded one or more times for use in the packaging arrangement.

In a further aspect, a package for a microwavable food item comprises a pair of separably joined, opposed panels that at least partially define a cavity for receiving a food item. Upon removal of the food item from the cavity, the panels can be reconfigured to form a microwave energy interactive heating sheet that collectively includes at least two susceptor layers and at least one layer of expandable insulating cells.

Other aspects, features, and advantages of the present invention will become apparent from the following description and accompanying figures.

BRIEF DESCRIPTION OF THE DRAWINGS

The description refers to the accompanying schematic drawings in which like reference characters refer to like parts throughout the several views, and in which.

DESCRIPTION

Figure 1A:
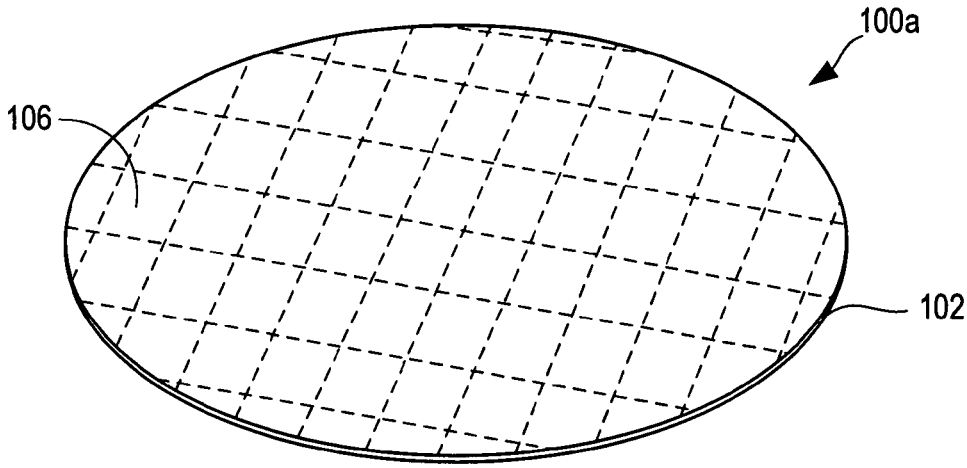
FIG. 1A is a schematic perspective view of an exemplary microwave energy interactive, single ply heating sheet according to various aspects of the invention.

The present invention relates generally to various materials, constructs, packages, and systems for microwave cooking of food items, and methods of making such materials and packages. Although several different aspects, implementations, and embodiments of the various inventions are provided, numerous interrelationships between, combinations thereof, and modifications of the various inventions, aspects, implementations, and embodiments of the inventions are contemplated hereby.

In one aspect, the invention is directed to a microwave energy interactive heating sheet ("heating sheet") that enhances the heating, browning, and/or crisping of a food item. The heating sheet may be provided with a particular food item or may be provided as a stand-alone product available for purchase without a particular food item.

The heating sheet generally includes at least two layers of microwave energy interactive material and at least one layer of expandable insulating cells. Each layer of microwave energy interactive material generally serves as a susceptor that absorbs microwave energy and converts it to thermal energy, which then can be transferred to an adjacent food item. As a result, the heating, browning, and/or crisping of the food item may be enhanced. Thus, stated otherwise, the heating sheet may generally include at least two susceptors and at least one layer of expandable insulating cells. The expandable insulating cells, which inflate upon sufficient exposure to microwave energy, provide thermal insulation that reduces loss of heat generated by the susceptors to the ambient heating environment.

The heating sheet may be formed as a unitary structure including multiple layers of different materials, or may be formed as a composite of multiple, pre-formed structures, each structure forming a ply of the heating sheet. The structures or plies may be joined partially or completely, or may remain separate.

One structure that may be suitable for use with the present invention is a microwave energy interactive insulating material. As used herein, the term "microwave energy interactive insulating material" (or "insulating material" or "insulating structure") refers any combination of layers of materials that both is responsive to microwave energy and is capable of providing some degree of thermal insulation when used to heat a food item. The various insulating materials alter the effect of microwave energy to enhance the heating, browning, and/or crisping of an adjacent food item, and provide thermal insulation to prevent loss of thermal energy to the ambient heating environment.

In one aspect, the insulating material comprises one or more susceptor layers in combination with one or more expandable insulating cells. Such materials sometimes may be referred to herein as "expandable cell insulating materials". Additionally, the insulating material may include one or more microwave energy transparent or inactive materials to provide dimensional stability, to improve ease of handling the microwave energy interactive material, and/or to prevent contact between the microwave energy interactive material and the food item. Thus, for example, the heating sheet may comprise a susceptor, a microwave energy interactive insulating material, a multi-layer susceptor material, a multi-layer microwave energy interactive insulating material, any other microwave energy interactive element, or any combination thereof.

In one particular example, the heating sheet may comprise a susceptor in combination with an expandable cell insulating material that also includes a susceptor. In another particular example, the heating sheet may comprise a plurality of pre-formed expandable insulating cell materials arranged in a stacked configuration, each of which includes at least one susceptor and at least one layer of expandable insulating cells. In still another particular example, the heating sheet may comprise a unitary structure including at least two susceptor layers and at least one layer of expandable insulating cells.

In another aspect, the invention is directed to a pouch, sleeve, or other package comprising a pair of opposed panels, where the combination of the panels includes at least two susceptor layers and at least one layer of expandable insulating cells. In accordance with one acceptable method, prior to heating, the food item may be removed from the pouch, sleeve, or other package and the opposed panels are arranged in a superposed configuration to form a heating sheet.

Various aspects of the invention may be illustrated by referring to FIGS. 1A-13B. For purposes of simplicity, like numerals may be used to describe like features. It will be understood that where a plurality of similar features are depicted, not all of such features are necessarily labeled on each figure. While various exemplary embodiments are shown and described in detail herein, it also will be understood that any of the features may be used in any combination, and that such combinations are contemplated hereby.

Figure 1B:
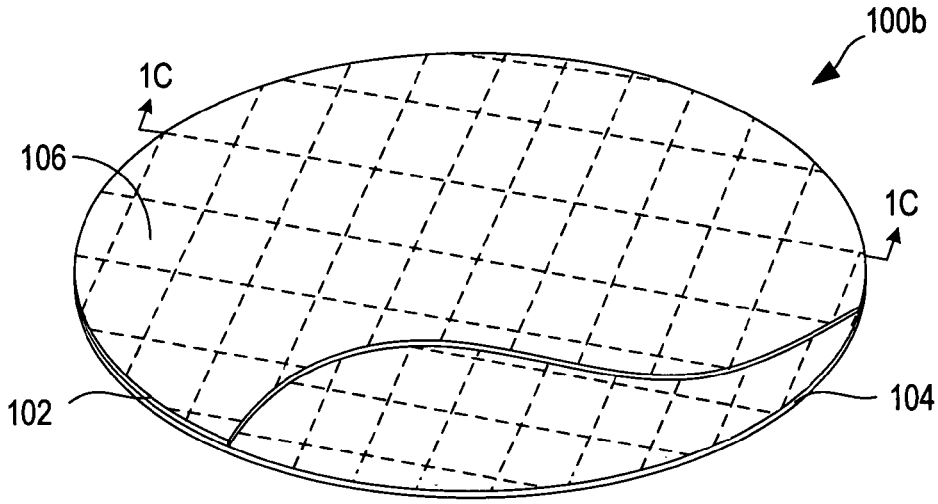
FIG. 1B is a schematic, partially cutaway, perspective view of an exemplary microwave energy interactive, multi-ply heating sheet according to various aspects of the invention.
Figure 1C:
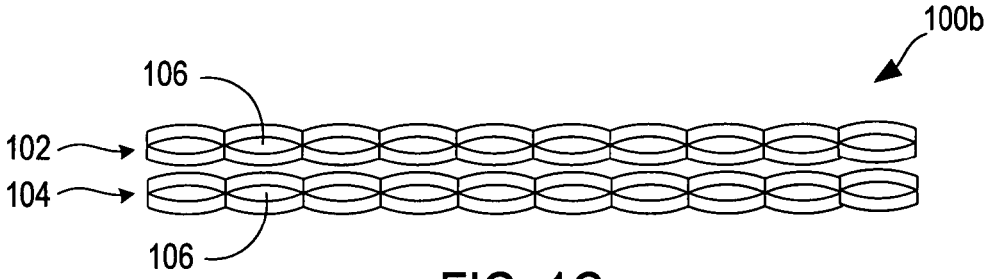
FIG. 1C is a schematic cross-sectional view of the exemplary microwave energy interactive heating sheet of FIG. 1B taken along a line 1C-1C, after exposure to microwave energy.

FIGS. 1A and 1B illustrate exemplary heating sheets 100*a*, 100*b* according to various aspects of the invention. In this example, the heating sheets 100*a*, 100*b* are substantially circular in shape, suitable for use with, for example, a pizza. However, any of the heating sheets or other constructs described herein or contemplated hereby may have any regular or irregular shape, for example, square, triangular, rectangular, or oval, as needed or desired for a particular food item or heating application. The heating sheet generally is dimensioned to be capable of contacting substantially the entire area to be heated, browned, and/or crisped. Thus, for example, where the food item is a circular pizza and the crust is to be browned and/or crisped, the heating sheet may be sized similarly to that of the pizza dough that forms the crust.

The heating sheet 100*a* may have a unitary, multi-layered, single ply 102 construction, as shown in FIG. 1A. Alternatively, the heating sheet 100*b* may comprise multiple plies 102, 104, each including one or more layers of various materials, as shown in FIG. 1B. Other constructions with additional plies are contemplated by the invention.

The construction 100*a* of FIG. 1A includes a plurality of layers (hidden from view), including at least two susceptor layers, at least one layer of expandable insulating cells 106 (indicated schematically with dashed lines), and optionally, various additional layers. Several examples of acceptable heating sheet 100*a* constructions are shown in FIGS. 4-12, which are discussed in detail below. Each of such constructions includes at least two susceptor layers (e.g, layers 202, 304, 404, 412), at least one layer of expandable insulating cells (e.g., layers 214, 318, 420), and various additional layers. Other examples of acceptable constructions are contemplated hereby.

In the construction 100*b* of FIG. 1B (shown schematically with the top layer 102 partially cutaway), at least one ply 102, 104 includes a layer of expandable insulating cells, and in this example, both plies 102, 104 include a plurality of expandable insulating cells 106 (indicated schematically with dashed lines). One or both of plies 102, 104 includes at least one susceptor layer, such that the heating sheet 100*b* includes at least two susceptor layers and at least one layer of expandable insulating cells 106. Each ply 102, 104 also may include other layers.

By way of example, the various structures illustrated in FIGS. 2A-13B provide examples of acceptable constructions for each of the plies 102, 104. Each of such structures includes at least one susceptor layer (e.g. layers 202, 304, 404, 412, 1302) and at least one layer of expandable insulating cells (e.g., layers 214, 318, 420, 1314). As will be discussed in detail below, some of such structures include only one susceptor layer. Such structures may be used in combination with one or more other structures, at least one of which includes a susceptor layer, to form a heating sheet 100*b* according to the invention.

As will be understood by those in the art, the plies 102, 104 may remain separate or may be joined partially or completely using any suitable process or technique, for example, thermal bonding, adhesive bonding, ultrasonic bonding or welding, mechanical fastening, or any combination thereof.

Regardless of the number of plies and manner of construction, the heating sheets 110*a*, 100*b* include at least two susceptor layers and at least one expandable insulating cell layer. Upon sufficient exposure to microwave energy, the expandable insulating cells 106 inflate to form a structure having a somewhat quilted or lofted appearance, as shown, for example, in schematic cross-sectional view in FIG. 1C. It is noted that, two rows of expandable insulating cells 106 are shown in an inflated state in FIG. 1C. However, a structure with only one layer, or with more than two layers, would only include one row or layer of inflated insulating cells, or more than two rows or layers as appropriate, respectively.

The actual appearance of the inflated structure may vary depending on numerous factors including, but not limited to, whether and to what extent the layers are joined, the size of the insulating cells, the number of layers of insulating cells, and the particular microwave oven and food item used. In any case, the heating sheet of the invention may be used in numerous ways to enhance the heating, browning, and crisping of the food item, as will be discussed further below.

Figure 1E:
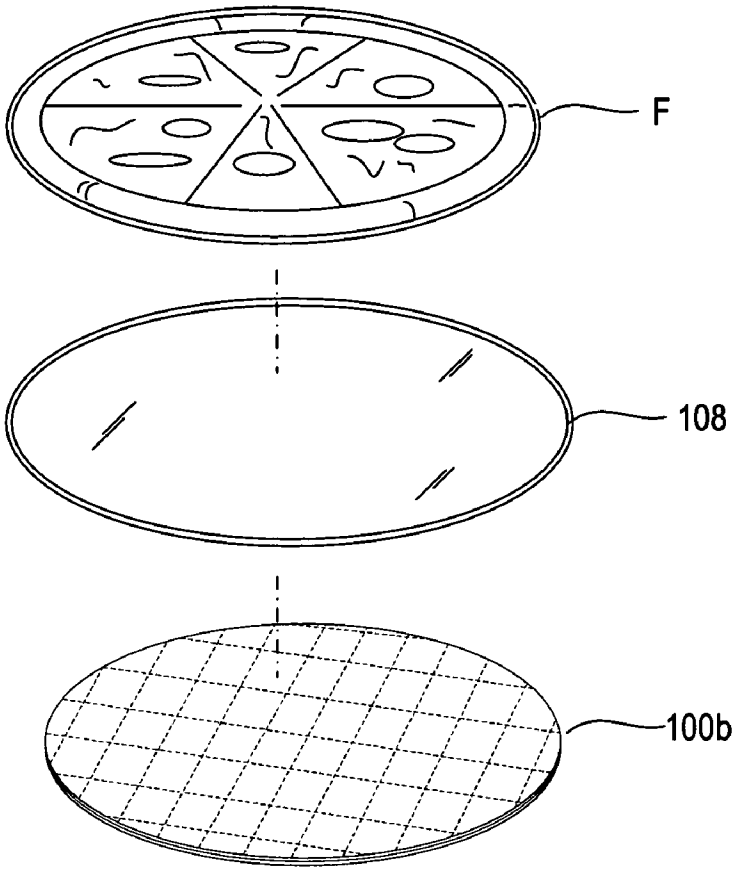
FIGS. 1D-1F are schematic, exploded perspective views of various packaging arrangements of a food item, dimensionally stable disk, and heating sheet, according to various aspects of the invention.
Figure 1D:
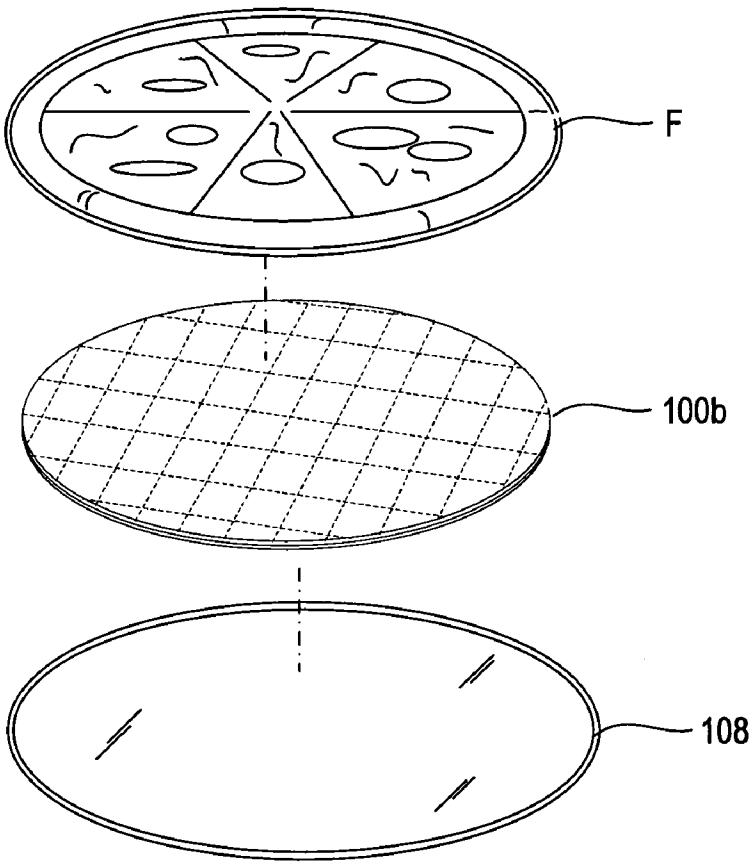
Figure 1G:
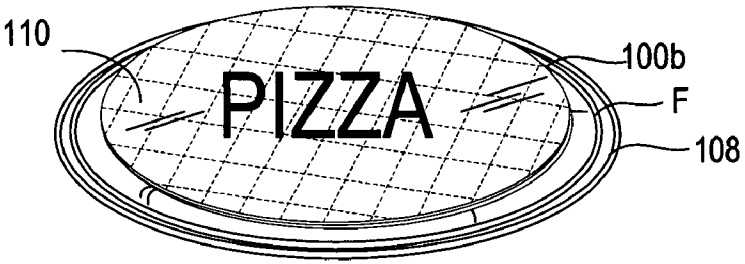
FIG. 1G is a schematic perspective view of the packaging components illustrated in FIG. 1F in a stacked configuration and enclosed by a film overwrap.
Figure 1H:
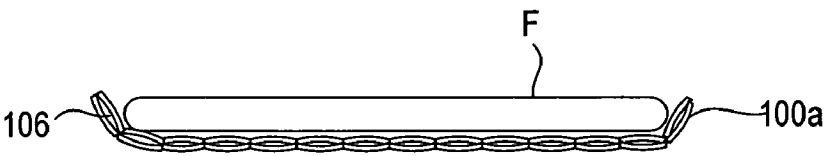
FIG. 1H is a schematic cross-sectional view of a food item seated on a microwave heating sheet, after exposure to microwave energy.
Figure 1F:
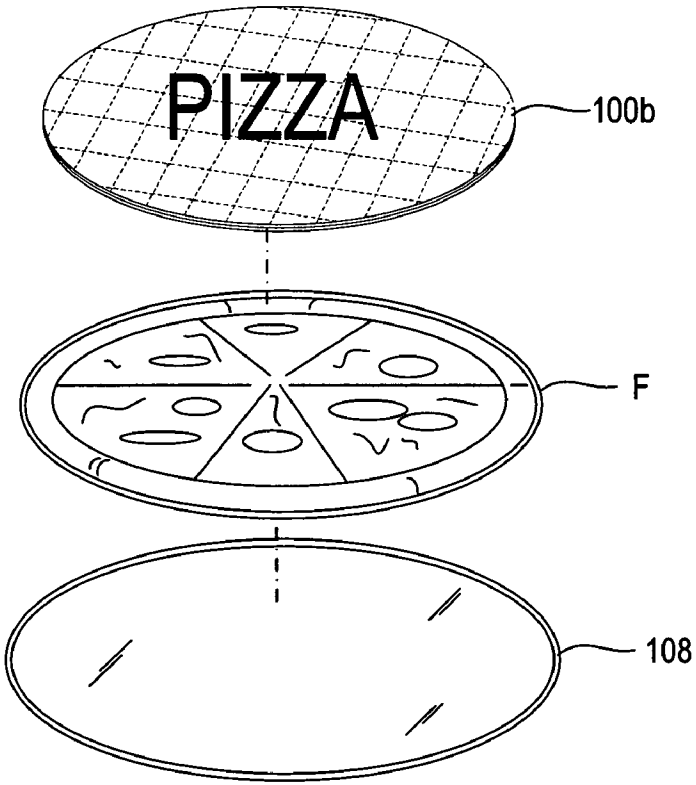

The heating sheet 100*a* or 100*b* may be provided to the user as a stand-alone product or may be provided with a food item. FIGS. 1D-1F schematically illustrate (in exploded views) several examples of packaging configurations including a heating sheet 100*b* according to the invention, a food item F, and a dimensionally stable construct, in this example, disk 108. it will be understood that such packaging configurations of the invention also may be used with heating sheet 100*a*.

The disk 108 may be formed of any suitable material, for example, a paperboard, corrugated board, a polymer or polymeric material, or any combination thereof. If desired, the disk may include one or more microwave energy interactive elements including, but not limited to, those described herein. In one particular example, a susceptor or susceptor film (not shown) overlies and is at least partially joined to the disk to further enhance the heating, browning, and or crisping of the food item.

Although the heating sheet 100*b* and disk 108 are illustrated as being separate components, it will be understood that the heating sheet 100*b* may be separate from the disk 108, may be partially joined to the disk 108, or may be completely joined to the disk 108, as needed or desired for the particular application. Where the heating sheet 100*b* and disk 108 are at least partially joined, such a structure may be referred to generally as a "heating disk".

In FIG. 1D, the heating sheet 100*b* lies between the food item F and the disk 108. In FIG. 1E, the heating sheet 100*b* lies beneath the disk 108. In FIG. 1F, the heating sheet 100*b* overlies the food item F. In such a case, the heating sheet 100*b* may include product information, heating instructions, nutritional information, or any other information if desired. In the example provided in FIG. 1F, the product identifier "PIZZA" is printed on the heating sheet 100*b*. Such information may be visible through an optional overwrap 110, as illustrated schematically in FIG. 1G.

It will be understood that while the dimensionally stable construct in the above examples is a substantially circular disk 108, the dimensionally stable construct may have any suitable shape, for example, square, rectangular, triangular, or any other regular or irregular shape. Furthermore, the dimensionally stable construct may comprise a platform with one or more support elements or "legs" that are capable of supporting the platform a desired distance from the floor of the microwave oven. The heating sheet 100*a*, 100*b* may be joined to the platform or may be a separate sheet.

Further, while several examples are provided herein, it will be understood that the heating sheets 100*a*, 100*b* may be used in numerous other packaging configurations, with or without a food item F and/or dimensionally stable disk 108, and may include other components, for example, instruction sheets, seasoning packets, condiments, utensils, and so forth. In some examples, the food item F and heating sheet 100*a* or 100*b* are placed into an outer carton (not shown) or wrapper without the dimensionally stable disk 108. In still other examples, the various components may be wrapped individually or collectively with an overwrap 110 or wrapper (schematically represented in FIG. 1G), which is typically a polymer film. Any such overwrap, for example, overwrap 110, is typically removed prior to heating the food item F.

The heating sheets 100*a*, 100*b* may be used in various ways and according to various methods, depending on the desired level of heating, browning, and/or crisping for the particular food item. In one example, the user may be instructed to position the food item F on the heating sheet 100*a* or 100*b*, such that the heating sheet 100*a* or 100*b* is seated on the floor or turntable (generally "floor") of the microwave oven (not shown). Alternatively, if a paperboard or corrugated disk 108 is provided, the user may be instructed to place the food item F on the heating sheet 100*a* or 100*b*, and the heating sheet 100*a* or 100*b* on the disk 108, so that the disk 108 is seated on the floor of the microwave oven (not shown).

In either example, as microwave energy impinges the heating sheet 100*a*, 100*b*, the expandable cells 106 inflate and urge one or both susceptor layers within the heating sheet 100*a*, 100*b* (see, e.g, susceptor layers in FIGS. 2A-13B) towards the surface of the food item F. In doing so, the heating, browning, and/or crisping of the food item F may be enhanced. Further, the inflated insulating cells 106 minimize loss of heat from the susceptors to the ambient heating environment, thereby further enhancing the heating, browning, and/or crisping of the food item.

In another example, the user may be instructed to place the food item F on the disk 108, and the heating sheet 100*a* or 100*b* beneath the disk 108, such that the heating sheet 100*a* or 100*b* is seated on the floor of the microwave oven (not shown). In such an instance, the heating sheet 100*a*, 100*b* serves primarily to elevate the food item F. Such instructions may be provided where, for example, the disk 108 includes a susceptor or other microwave energy interactive element. By elevating the disk 108, and therefore, the susceptor overlying the disk 108, more of the heat generated by the susceptor overlying the disk 108 can be transferred to the food item F instead of being lost by conduction to the floor of the microwave oven. Additionally, some of the heat generated by the susceptors within the heating sheet 100*a*, 100*b* may be transferred to the susceptor on the disk 108 and to the food item F seated on the disk 108.

It will be understood that, in some instances, it may be beneficial to use a heating sheet 100*a*, 100*b* that has an area greater than the base area of the food item to be heated. Using such an "oversized" heating sheet 100*a*, 100*b* may be beneficial if the food item has a vertical dimension or component that is desired to be browned and/or crisped. For instance, where the food item F to be heated is a pizza having a thick crust, it may be beneficial to provide a heating sheet 100*a*, 100*b* that is sufficiently large to permit the inflating expandable cells 106 to wrap upwardly around the periphery of the crust, as illustrated schematically in FIG. 1H with a heating sheet 100*a* including one layer of expandable insulating cells 106. In doing so, at least one susceptor within the heating sheet 100*a*, 100*b* may be brought into closer proximity to the peripheral crust to improve browning and/or crisping thereof.

Figure 1L:
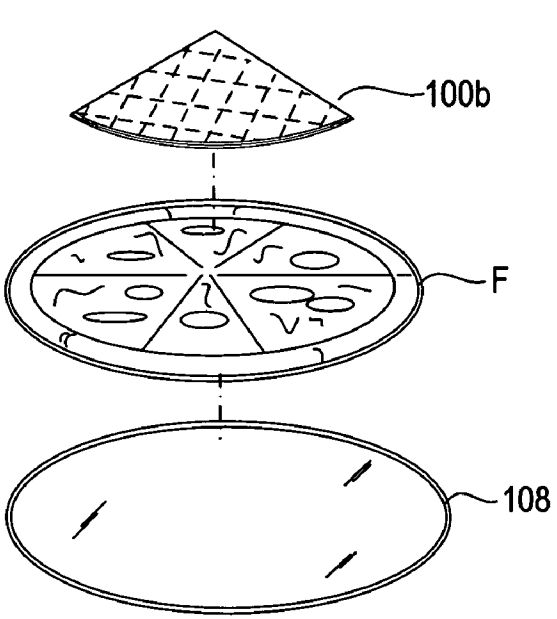
FIGS. 1J-1L are schematic, exploded perspective views of various packaging arrangements of a food item, dimensionally stable disk, and folded heating sheet, according to various aspects of the invention.
Figure 1K:
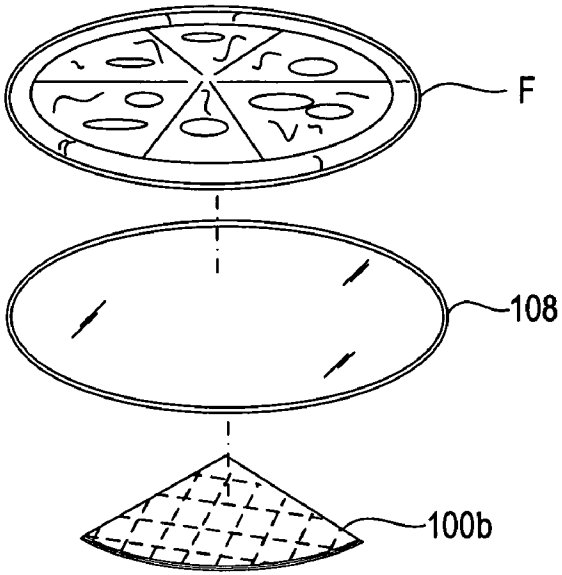
Figure 1J:
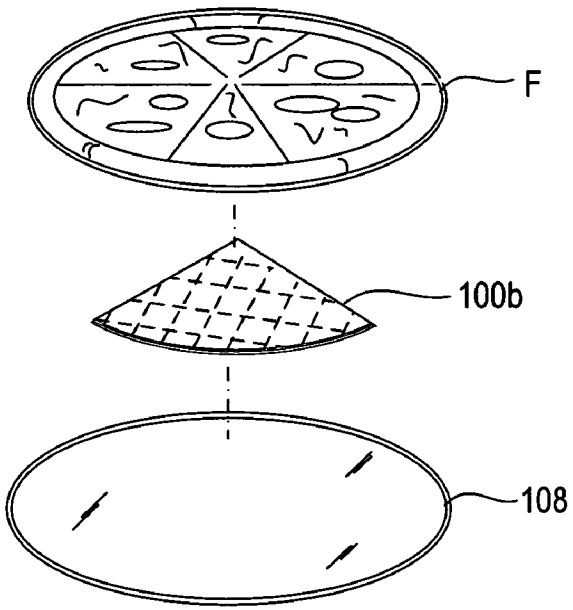
Figure 1M:
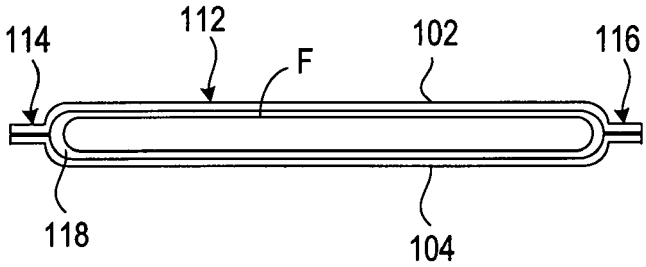
FIG. 1M is a schematic cross-sectional view of an exemplary package for a food item, where the package may be used to form a heating sheet, according to various aspects of the invention.

As such, in other exemplary packaging arrangements illustrated in FIGS. 1J-1L (in exploded views), the "footprint" of the heating sheet 100*b* is reduced by folding the heating sheet 100*b* one or more times prior to packaging. It will be understood that such arrangements also may be used with heating sheet 100*a* according to the invention.

For example, in FIG. 1J, the heating sheet 100*b* is folded into one-quarter its original size and placed between the food item F and disk 108. In FIG. 1K, the folded heating sheet 100*b* is placed beneath or behind the disk 108, distal the food item F. In FIG. 1L, the folded heating sheet 100*b* overlies the food item seated on the disk 108. In such an example, the heating sheet 100*b* may be printed with full color graphics and may provide product information, heating instructions, nutritional information, or any other information, in the same manner discussed in connection with FIGS. 1F and 1G.

Figure 1N:
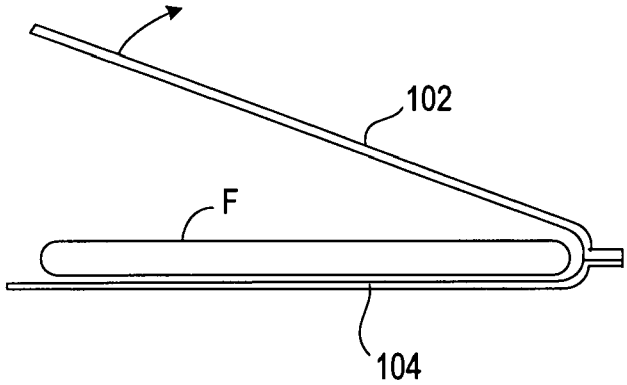
FIG. 1N is a schematic cross-sectional view of the package of FIG. 1M in a partially open configuration.
Figure 1P:
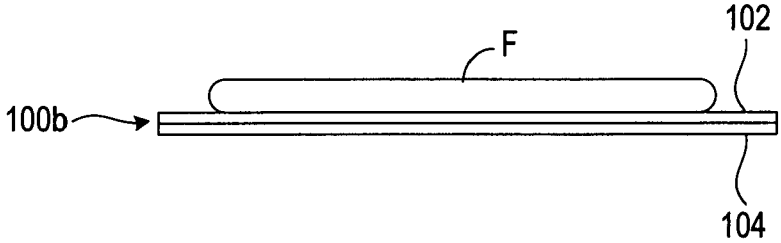
FIG. 1P is a schematic cross-sectional view of the package of FIG. 1M, formed into a multi-ply heating sheet with the food item thereon.
Figure 1Q:
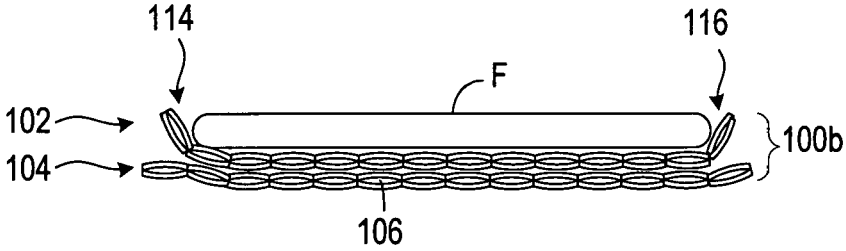
FIG. 1Q is a schematic cross-sectional view of the heating sheet of FIG. 1P, after exposure to microwave energy.

In still other exemplary package configurations depicted schematically in FIGS. 1M-1Q, the first or top ply 102 and the second or bottom ply 104 of the insulating sheet 100*b* of FIG. 1B collectively serve as an overwrap 112 for the food item F. The top and bottom plies 102, 104 are joined along at least a portion of respective peripheral edges 114, 116 to form a cavity or interior space 118 for receiving the food item F. The plies 102, 104 may be joined in any suitable manner, for example, heat sealing, adhesives, or any other chemical or mechanical means. In accordance with one acceptable method, prior to heating the food item F, at least a portion of the joined peripheral areas or edges 114, 116 may be opened to separate the two layers 102, 104 as needed to remove the food item F from the interior space 118, as shown in FIG. 1N. The plies 102, 104 then may be repositioned in a superposed relationship, optionally still partially joined to one another, and the food item may be positioned on the heating sheet 100*b*, as shown in FIG. 1P.

Upon exposure to microwave energy, the expandable cells 106 inflate, as described previously (FIG. 1Q). Since the heating sheet 100*b* is generally greater in dimensions (e.g., length and width) than the food item F, at least a portion of the peripheral area or edges 114, 116 of the heating sheet 100*b* may tend to bulge upwardly along the sides of the food item F, thereby bringing the susceptor in the top ply 102 of the heating sheet 100*b* into closer proximity to the surface of the food item F. In doing so, the browning and/or crisping of the sides of the food item F may be enhanced. The elevating and insulating properties of the expanded insulating sheet 100*b* further enhance the heating, browning, and crisping of the food item F.

Figure 1R:
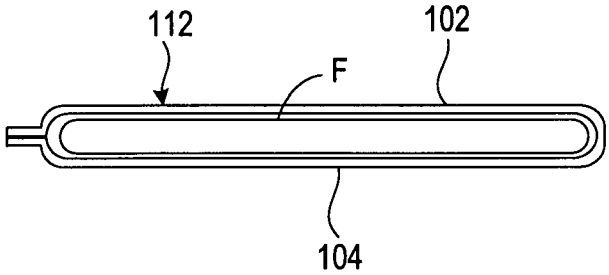
FIG. 1R is a schematic cross-sectional view of the package of FIG. 1M, formed from a material folded over onto itself.

It is noted that, in the example shown in FIGS. 1M-1Q, the overwrap 112 is formed from two individual plies 102, 104 of expandable cell insulating material joined along respective edges. However, in this and other aspects of the invention, the overwrap 112 may be formed from a single ply of material folded over onto itself, as shown in FIG. 1R. In such an example, the overwrap 112 may be formed from a structure 100*a* according to FIG. 1A using, for example, any of the structures illustrated in FIGS. 4-12, or may be formed from a structure 100*b* according to FIG. 1B using any combination of plies, for example, any of the structures illustrated in FIGS. 2A-13B, as needed to attain at least two susceptor layers and at least one layer of expandable insulating cells in the resulting heating sheet. Thus, for example, one ply may consist of a structure as shown in FIGS. 2A-3, 13A, or 13B and one ply may be formed from another such material, a susceptor (optionally supported on or between one or more layers of microwave energy transparent material, e.g., paper or polymer film), or may be any other suitable structure including a susceptor layer. Numerous variations are contemplated hereby.

In another exemplary use, the various heating sheets 100*a*, 100*b* may be used as a heating wrap in which the food item is enfolded or enclosed throughout at least a portion of the heating cycle. This might be suitable for food items having multiple surfaces to be browned and/or or crisped, for example, an egg roll, breaded meat, fruit pie, sandwich, burrito, breakfast wrap, pastry, or other item. In yet another exemplary use, where at least one of the top ply 102 and bottom ply 104 include at least two susceptor layers and at least one layer of expandable cells (e.g., with the exemplary structures shown in FIGS. 4-12), such that the ply 102 or 104 serves as a heating sheet according to the invention, the food item may be heated within the package.

Various microwave energy interactive insulating materials may be suitable for use in a heating sheet, wrap, package, or other construct according to the invention. The various insulating materials may include multiple layers or components, including both microwave energy responsive or interactive elements or components and microwave energy transparent or inactive elements or components, provided that each is resistant to softening, scorching, combusting, or degrading at typical microwave oven heating temperatures, for example, at from about 250° F. to about 425° F.

In one aspect, the insulating material may comprise one or more susceptor layers in combination with one or more expandable insulating cells.

In another aspect, the insulating material may comprise a microwave energy interactive material supported on a first polymer film layer, a moisture-containing layer superposed with the microwave energy interactive material, and a second polymer film layer joined to the moisture-containing layer in a predetermined pattern using an adhesive, chemical or thermal bonding, or other fastening agent or process, thereby forming one or more closed cells between the moisture-containing layer and the second polymer film layer. The microwave energy interactive material may serve as a susceptor. The closed cells expand or inflate in response to being exposed to microwave energy and cause the susceptor to bulge and deform toward the food item.

While not wishing to be bound by theory, it is believed that the heat generated by the susceptor causes moisture in the moisture-containing layer to evaporate, thereby exerting pressure on the adjacent layers. As a result, the expandable cells bulge outwardly away from the expanding gas, thereby allowing the expandable cell insulating material to conform more closely to the contours of the surface of the food item. As a result, the heating, browning, and/or crisping of the food item can be enhanced, even if the surface of the food item is somewhat irregular.

Further, the water vapor, air, and other gases contained in the closed cells provide insulation between the food item and the ambient environment of the microwave oven, thereby increasing the amount of sensible heat that stays within or is transferred to the food item. Such insulating materials also may help to retain moisture in the food item when cooking in the microwave oven, thereby improving the texture and flavor of the food item. Additional benefits and aspects of such materials are described in PCT Publication No. WO 2003/66435, published Aug. 14, 2003, U.S. Pat. No. 7,019,271, and U.S. Pat. No. 7,351,942, each of which is incorporated by reference herein in its entirety.

It is noted that, for purposes of simplicity, and not limitation, the predetermined pattern of adhesion, bonding, or fastening may be generally referred to herein as "lines of adhesion" or a "pattern of adhesion" or a "patterned adhesive". However, it will be understood that there are numerous methods of forming the closed cells, and that such methods are contemplated hereby.

Several exemplary insulating materials are depicted in FIGS. 2A-13B. As discussed above, the various plies 102, 104 of the heating sheets 100*a*, 100*b* of the invention may comprise, may consist essentially of, or may consist of such structures, as needed to attain a heating sheet with at least two susceptor layers and at least one layer of expandable insulating cells. In each of the examples shown herein, it should be understood that the layer widths are not necessarily shown in perspective. In some instances, for example, the adhesive layers may be very thin with respect to other layers, but are nonetheless shown with some thickness for purposes of clearly illustrating the arrangement of layers. Since some of such exemplary structures include only one susceptor layer, it is understood that those structures may be used as one ply of the heating sheet in combination with another ply that includes a susceptor layer, such that the heating sheet includes at least two susceptor layers and at least one layer of expandable insulating cells.

Figure 2A:
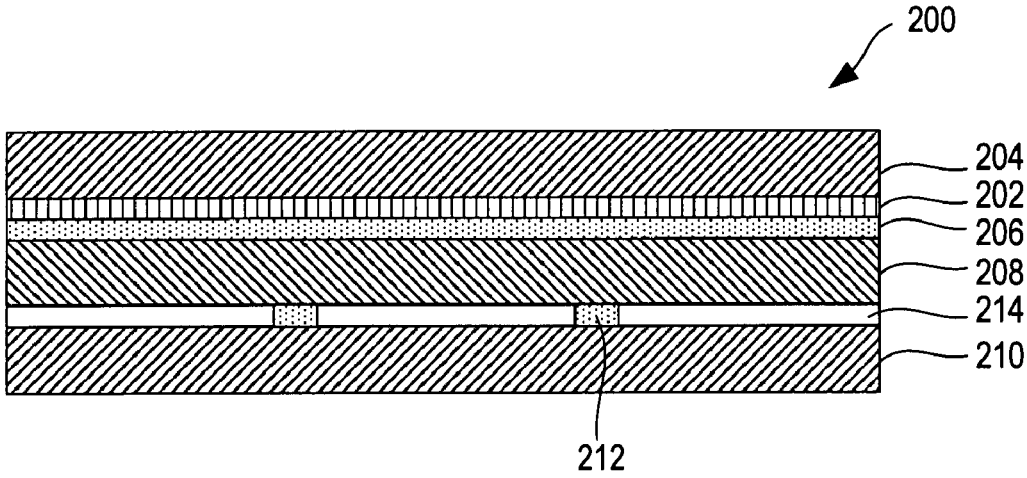
FIG. 2A is a schematic cross-sectional view of an exemplary microwave energy interactive insulating material that may be used in accordance with various aspects of the invention.
Figure 2B:
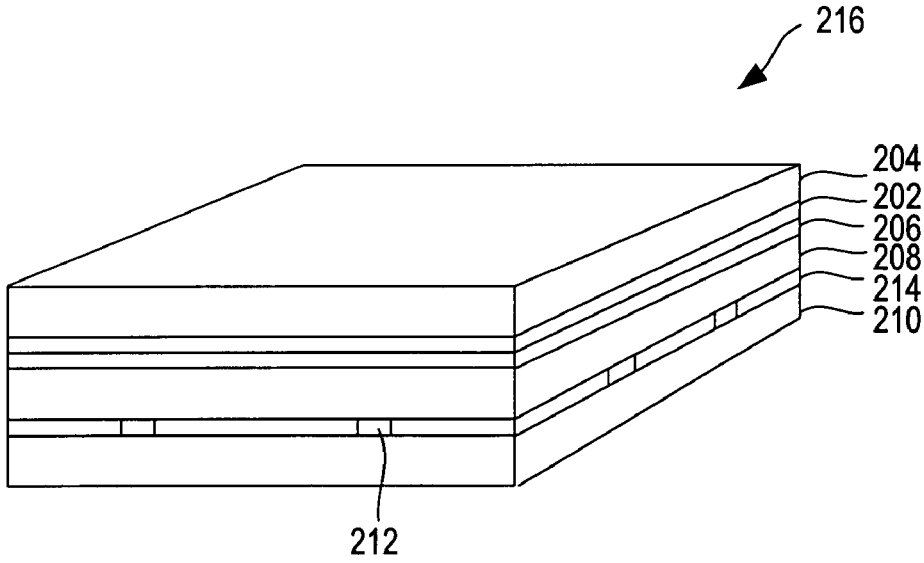
FIG. 2B is a schematic perspective view of the microwave energy interactive insulating material of FIG. 2A, in the form of a cut sheet.

FIG. 2A depicts an exemplary microwave energy interactive insulating material 200 that may be suitable for use with the various aspects of the invention. In this example, a thin layer of microwave energy interactive material that serves as a susceptor 202 is supported on a first polymer film 204 (collectively forming a "susceptor film") and bonded by lamination with an adhesive 206 (or otherwise) to a dimensionally stable substrate 208, for example, paper. The substrate 208 is bonded to a second polymer film 210 using a patterned adhesive 212 or other material, thereby forming a plurality of expandable insulating cells 214. The insulating material 200 may be cut and provided as a substantially flat, multi-layered sheet 216, as shown in FIG. 2B.

Figure 2C:
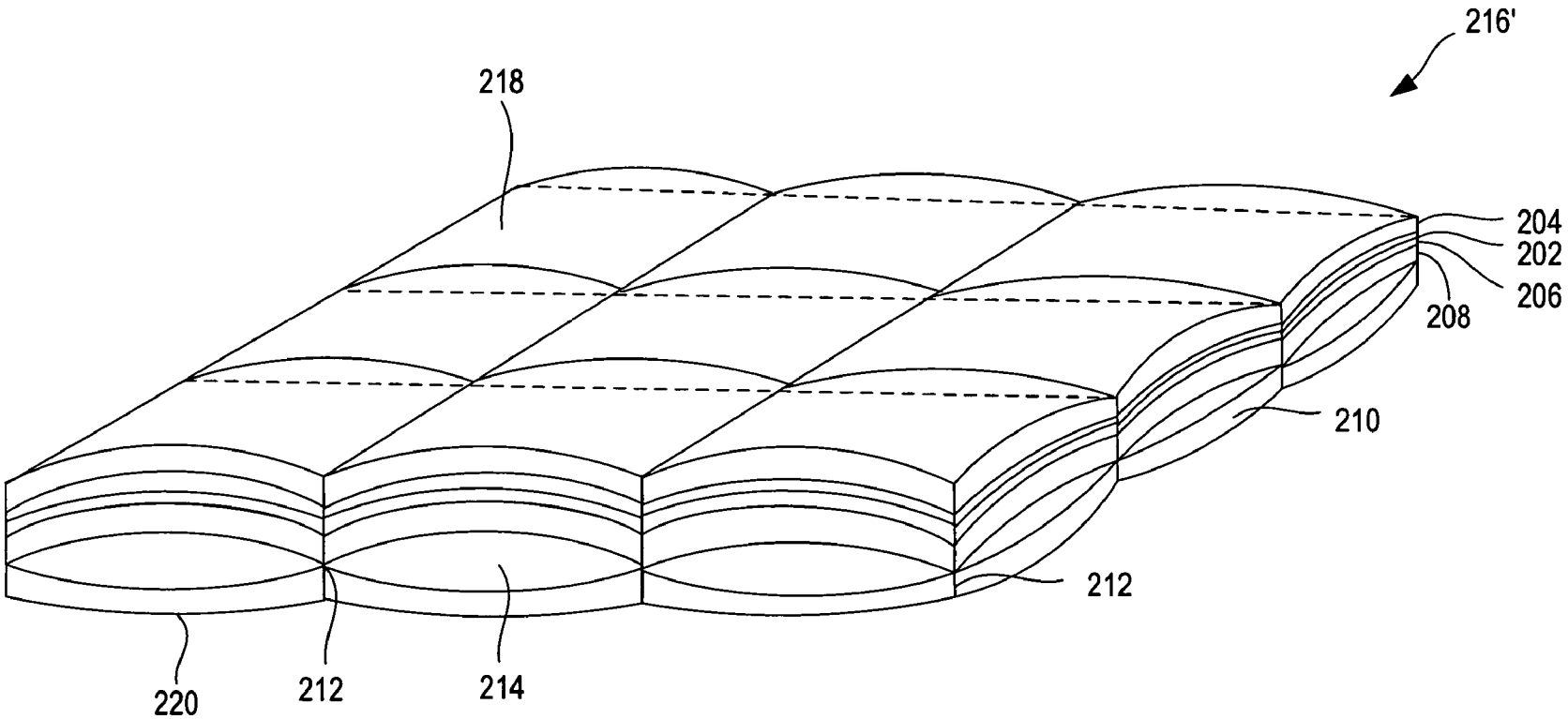
FIG. 2C is a schematic perspective view of the microwave energy interactive insulating material of FIG. 2B, after sufficient exposure to microwave energy.

As the susceptor 202 heats upon impingement by microwave energy, water vapor and other gases typically held in the substrate 208, for example, paper, and any air trapped in the thin space between the second polymer film 210 and the substrate 208 in the closed cells 214, expand, as shown in FIG. 2C. The resulting insulating material 216' has a quilted or pillowed or lofted top surface 218 and bottom surface 220. When microwave heating has ceased, the cells 214 typically deflate and return to a somewhat flattened state.

Figure 2D:
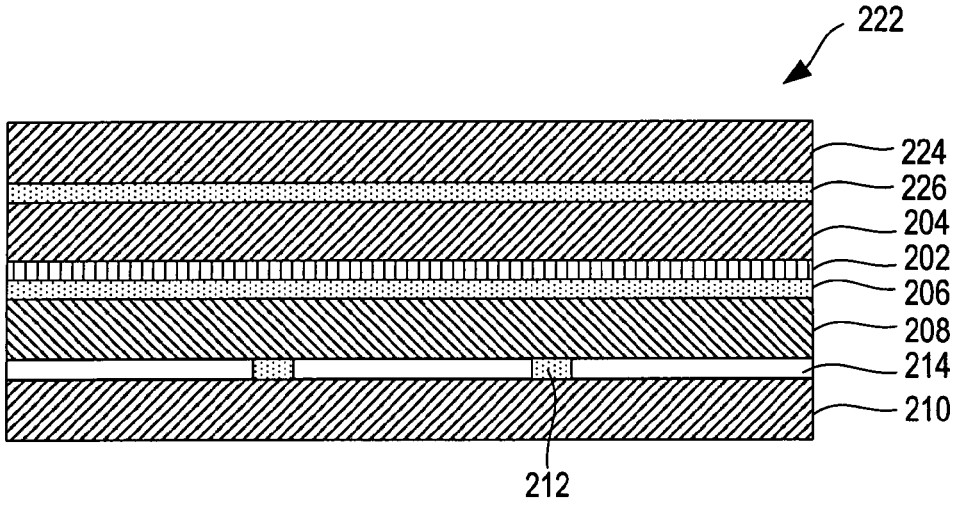
FIG. 2D is a schematic cross-sectional view of a variation of the exemplary microwave energy interactive insulating material of FIG. 2A.

If desired, the insulating material 200 may be modified to form a structure 222 that includes an additional paper or polymer film layer 224 joined to the first polymer film layer 204 using an adhesive 226 or other suitable material, as shown in FIG. 2D. In either case, the insulating materials 200 and 222 may be used in combination with one or more other structures, at least one of which includes a susceptor layer, to form a heating sheet according the invention, such that the heating sheet includes at least two susceptor layers and at least one layer of expandable insulating cells.

Figure 3:
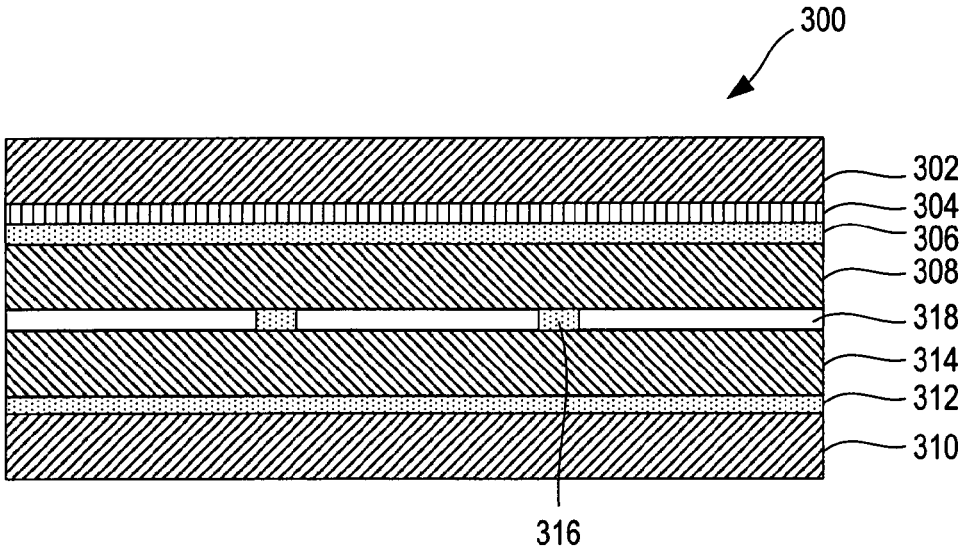
FIGS. 3-12 are schematic cross-sectional views of other exemplary microwave energy interactive insulating materials that may be used in accordance with various aspects of the invention.

FIG. 3 illustrates another exemplary insulating material 300. The material 300 includes a polymer film layer 302, a susceptor layer 304, an adhesive layer 306, and a paper layer 308. Additionally, the material 300 may include a second polymer film layer 310, an adhesive 312, and a paper layer 314. The layers may be adhered or affixed by a patterned adhesive 316 that defines a plurality of closed expandable cells 318.

Figure 4:
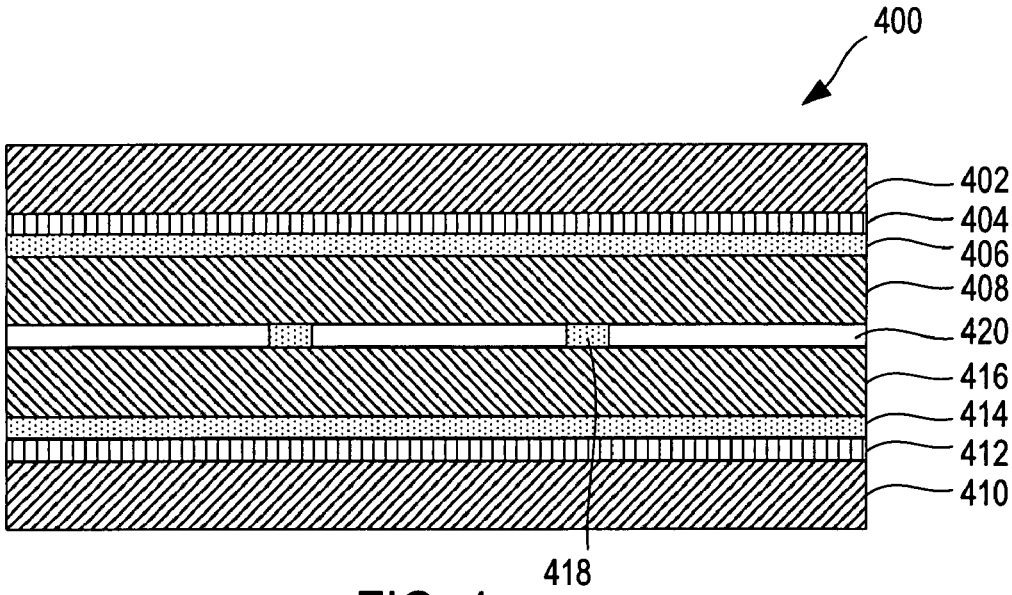

FIG. 4 illustrates yet another exemplary insulating material 400 that may be suitable for use with the invention. In this example, the insulating material 400 includes a pair of adjoined, symmetrical layer arrangements. If desired, the two symmetrical arrangements may be formed by folding one layer arrangement onto itself.

The first symmetrical layer arrangement, beginning at the top of the drawing, comprises a polymer film layer 402, a susceptor layer 404, an adhesive layer 406, and a paper or paperboard layer 408. The adhesive layer 406 bonds the polymer film 402 and the susceptor layer 404 to the paperboard layer 408.

The second symmetrical layer arrangement, beginning at the bottom of the drawing, also comprises a polymer film layer 410, a susceptor layer 412, an adhesive layer 414, and a paper or paperboard layer 416. A patterned adhesive layer 418 is provided between the two paper layers 408 and 416, and defines a pattern of closed cells 420 configured to expand when exposed to microwave energy.

By using an insulating material 400 having one susceptor 404 and 412 on each side of the expandable insulating cells 420, more heat is generated, thereby achieving greater loft of the cells 420. As a result, such a material is able to elevate a food item seated thereon to a greater extent than an insulating material having a single susceptor layer.

Figure 5:
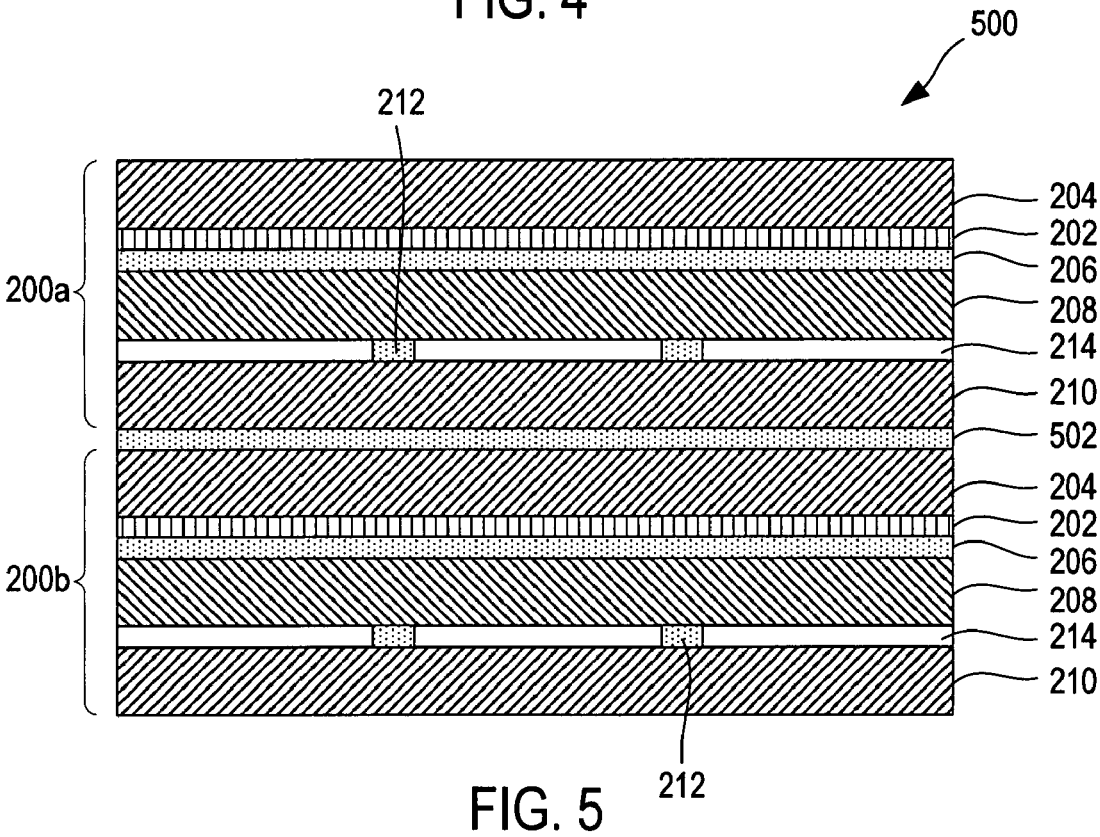

FIG. 5 illustrates yet another exemplary insulating material 500 according to the present invention. The insulating material 500 comprises two plies 200*a* and 200*b* of the insulating material 200 of FIG. 2A arranged in a stacked back-to-front configuration, where the term "back" corresponds to polymer film layer 210 and "front" refers to polymer film layer 204. The plies 200*a* and 200*b* are joined by an adhesive layer 502. However, the plies 200*a* and 200*b* may be joined in any suitable manner.

The degree of joining or bonding may vary for a given application. For example, if the greatest degree of loft is desirable, it might be beneficial to use a discontinuous, patterned adhesive bond that will not restrict the expansion and flexing of the layers within the material. As another example, where structural stability is desirable, a continuous adhesive bond might provide the desired result.

In the structure 500 shown in FIG. 5, the insulating material 500 includes two layers of expandable cells 214. In use, such structures materials are able to achieve a greater degree of loft. This may be particularly advantageous where the food item has a greater weight and, therefore, is more difficult to elevate from the floor of the microwave oven.

Figure 6:
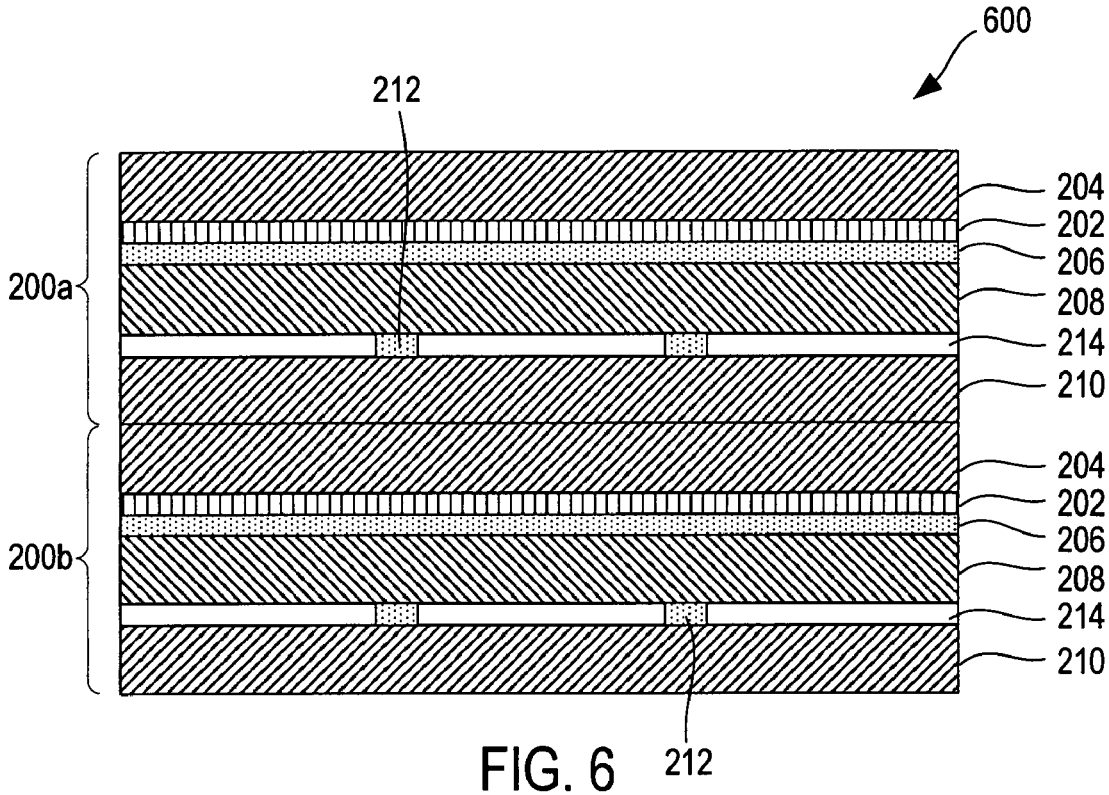

FIG. 6 illustrates yet another exemplary insulating material 600 according to the present invention. The insulating material 600 comprises two plies 200*a*, 200*b* of the insulating material 200 of FIG. 2A arranged in a stacked back-to-front configuration, where the term "back" corresponds to polymer film layer 210 and "front" refers to polymer film layer 204. The plies 200*a*, 200*b* are joined using continuous or intermittent welding or fusion. However, the layers may be joined in any suitable manner.

Figure 7:
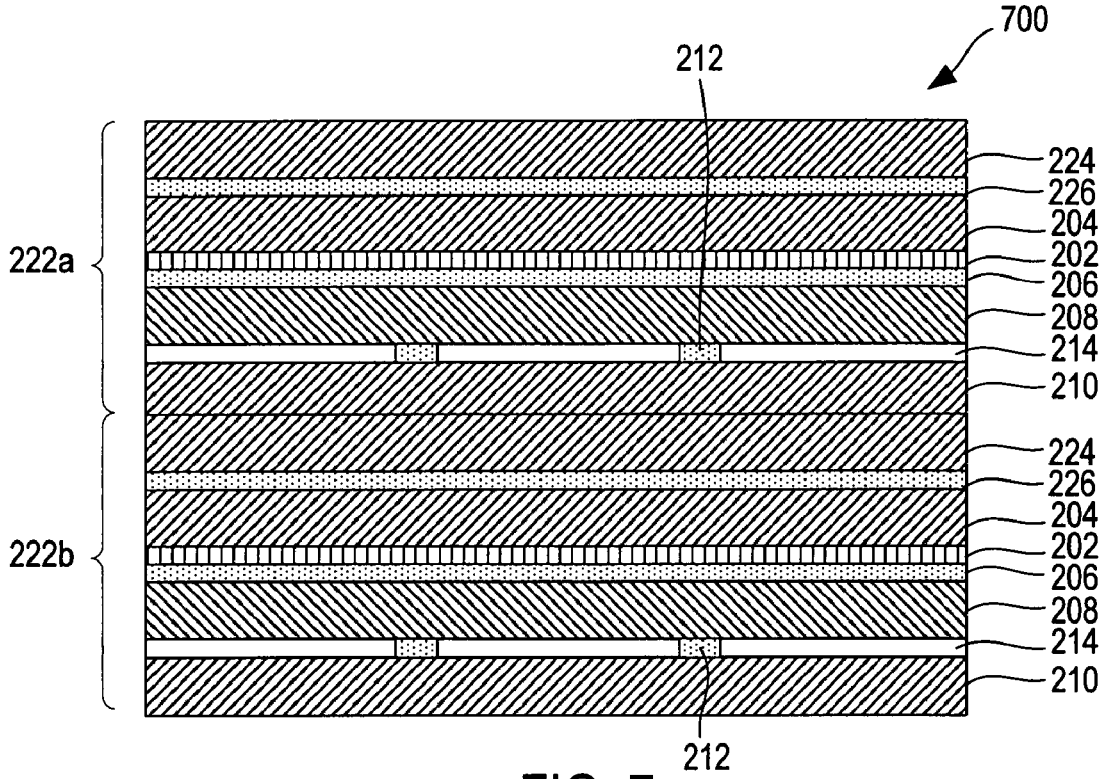
Figure 8:
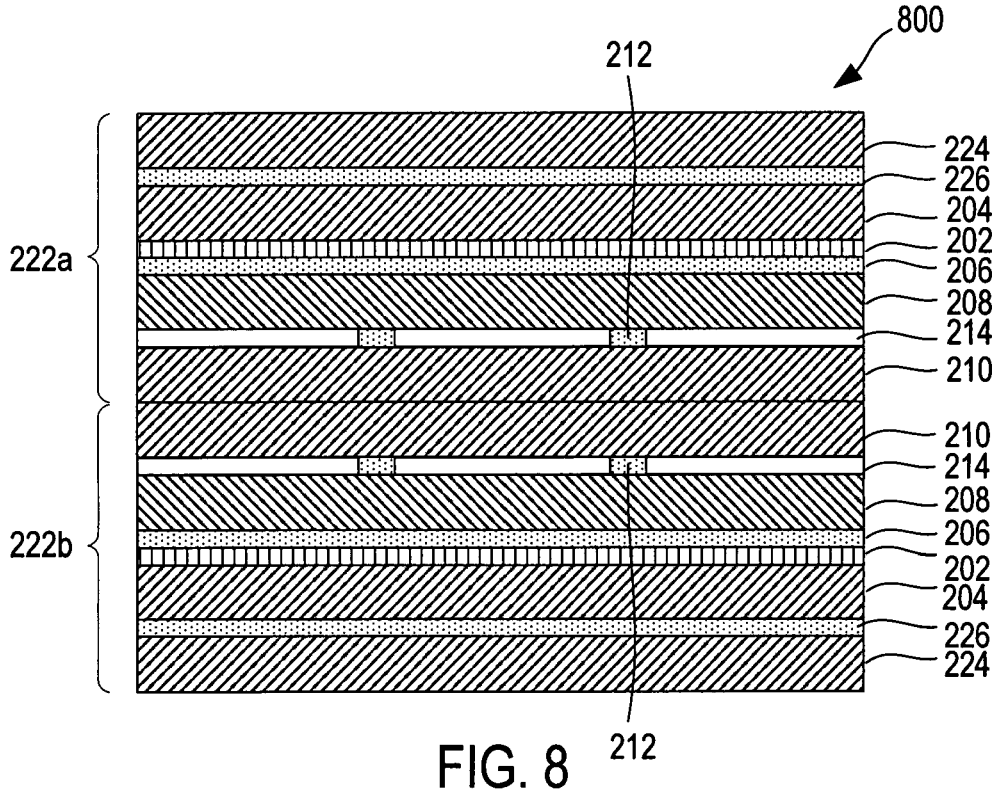

Similarly, FIGS. 7 and 8 depict insulating structures that include two plies 222*a*, 222*b* of the material 222 of FIG. 2D. In the exemplary material 700 of FIG. 7, the plies 222*a* and 222*b* of insulating material are arranged in a back-to-front configuration, where "back" corresponds to layer 210 and "front" corresponds to layer 224 and. In the exemplary material 800 of FIG. 8, the plies 222*a* and 222*b* are arranged in a back-to-back configuration. The plies may be joined in any suitable manner, such as those described above, for example, by welding or fusing.

Figure 9:
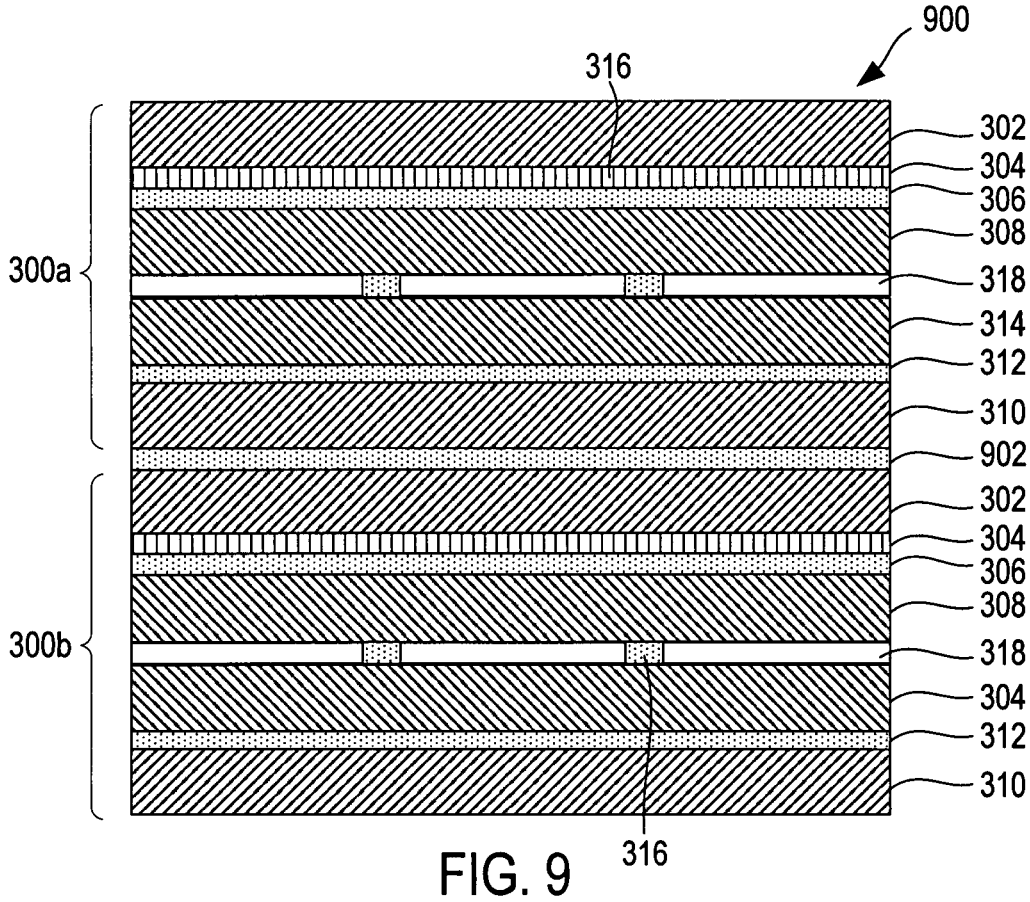
Figure 10:
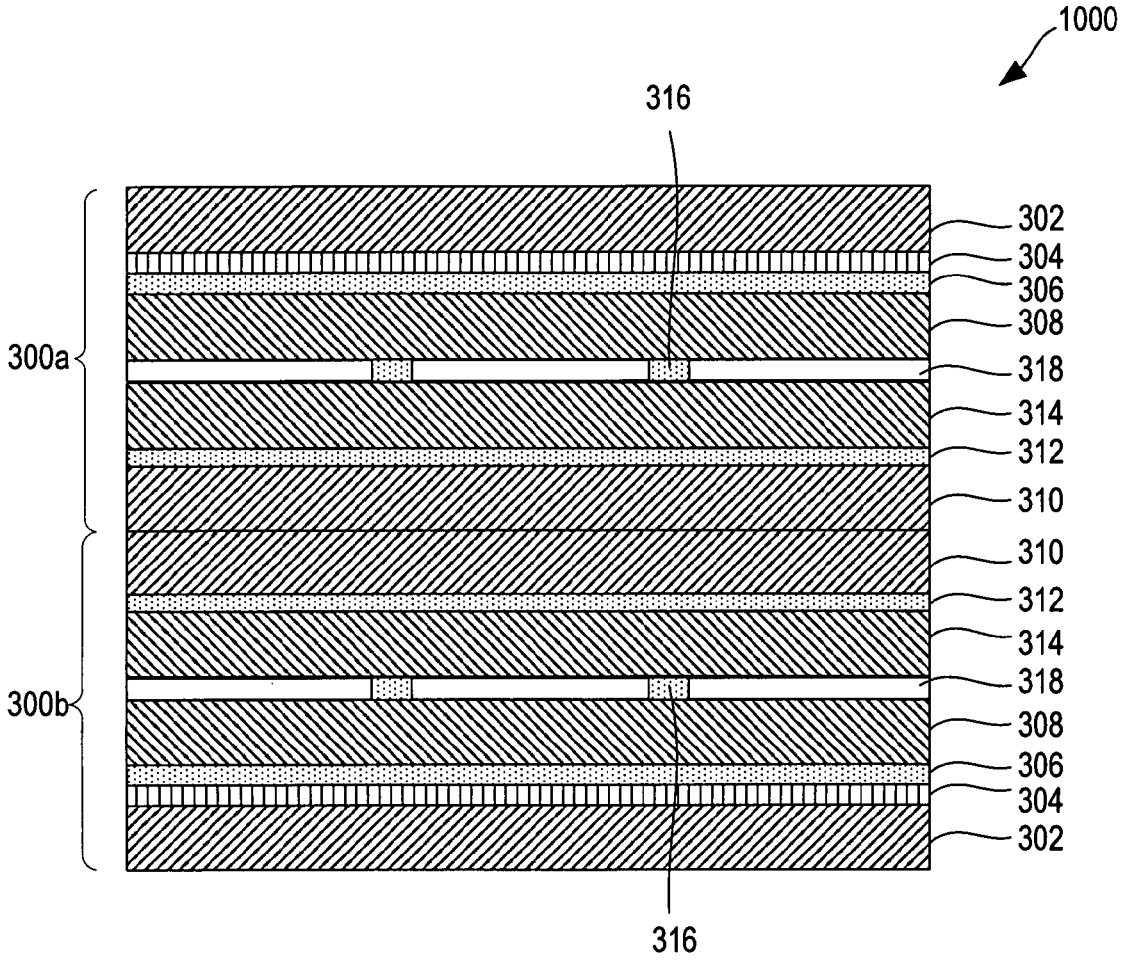

FIGS. 9 and 10 depict additional insulating materials 900 and 1000 comprising plies 300*a* and 300*b* of the insulating material 300 of FIG. 3. In FIG. 9, plies 300*a* and 300*b* are arranged in a back-to-front configuration joined by an adhesive layer 902, where "back" refers to the polymer film layer 310 and "front" refers to the polymer film layer 302. In FIG. 10, plies 300*a* and 300*b* are arranged in a layered, back-to-back configuration and joined using welding or fusing, or any other suitable technique.

Figure 11:
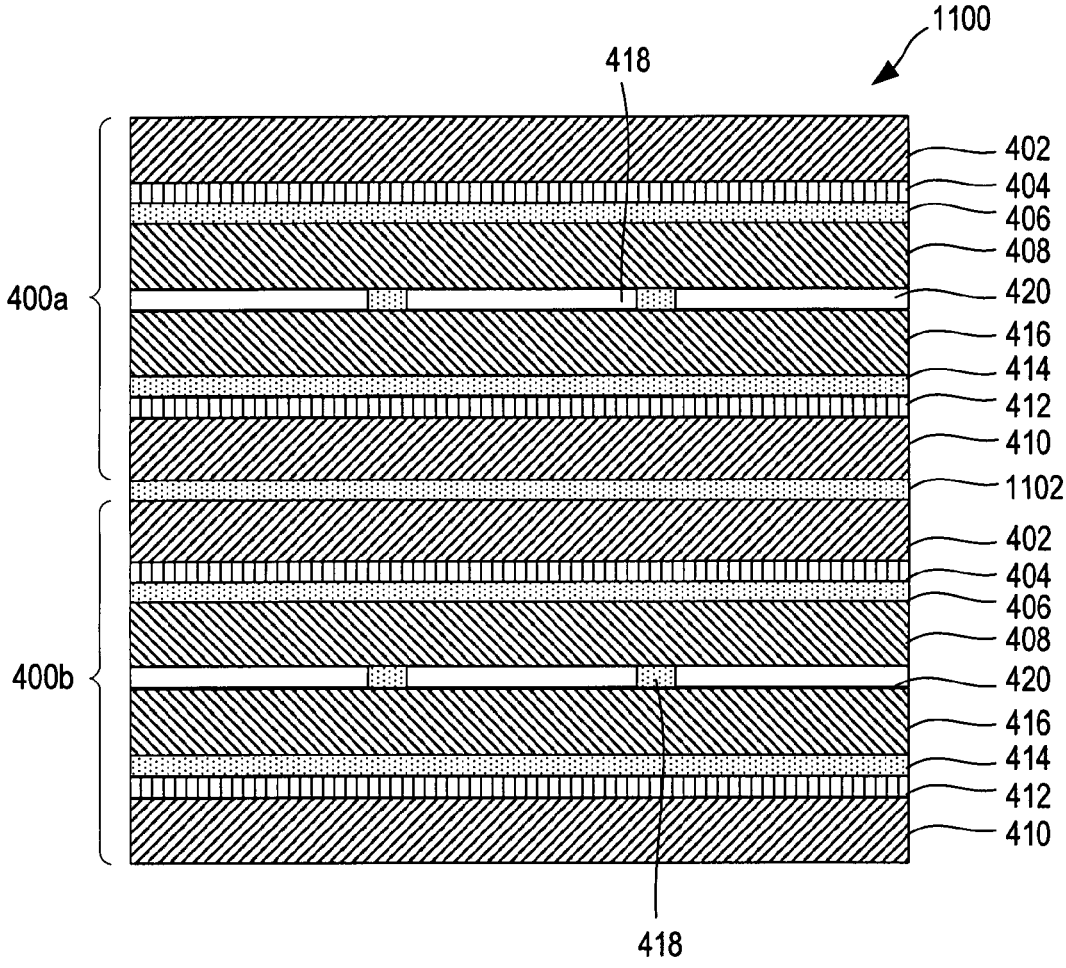
Figure 12:
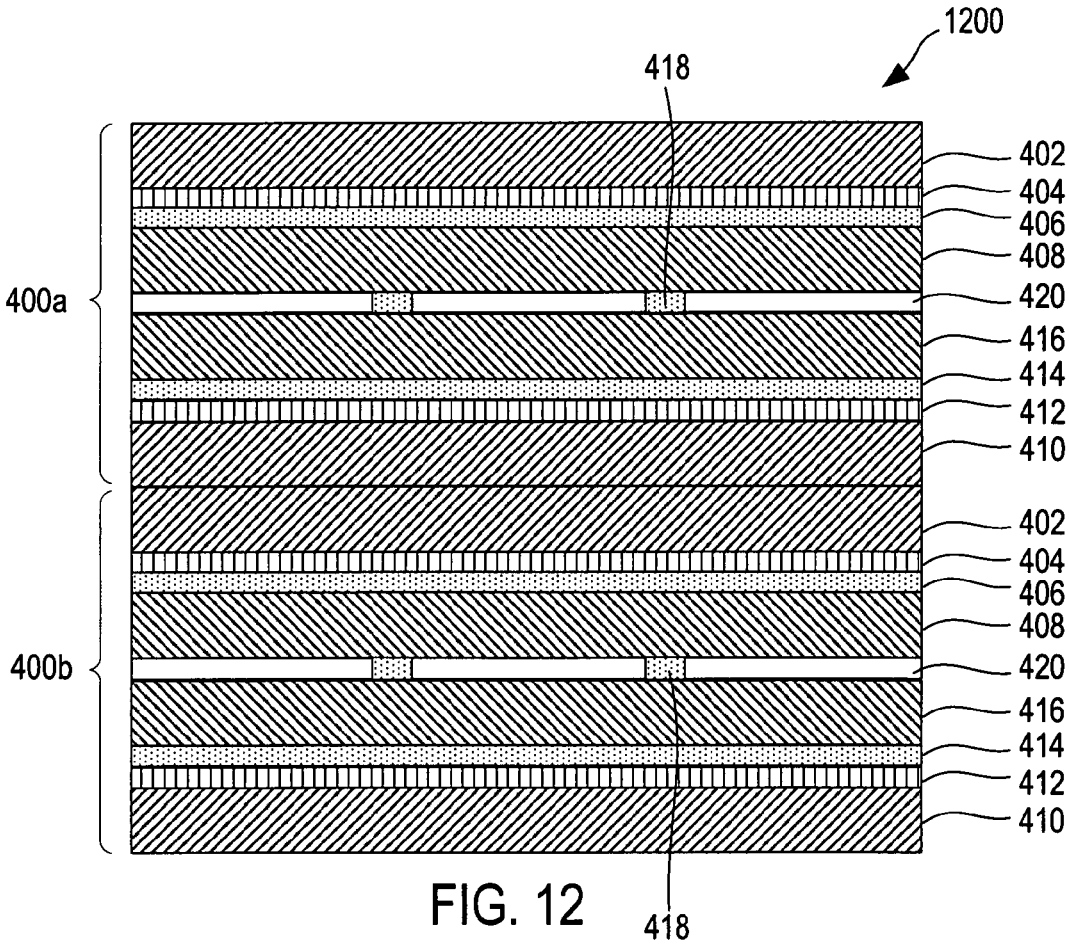

As further examples, FIGS. 11 and 12 depict insulating materials 1100 and 1200 comprising the insulating material 400 of FIG. 4 in a layered configuration. In FIG. 11, plies 400*a* and 400*b* are arranged in a back-to-front configuration, where "back" refers to layer 410 and "front" refers to layer 402. Plies 400*a* and 400*b* joined by an adhesive layer 1102. In FIG. 12, plies 400*a* and 400*b* are arranged in a back-to-back configuration and joined using welding or fusing, or any other suitable technique.

It will be understood that although the various examples of FIGS. 5-12 illustrate two layers of like insulating materials, numerous other layered constructions, in which the same or different insulating materials are used in a front-to-front, front-to-back, back-to-back, or any combination thereof, are contemplated hereby. Thus, by way of example and not limitation, the insulating material of FIG. 5 may be used with the insulating material of FIG. 6 in a front-to-front, front-to-back, or back-to-back configuration, as desired.

Furthermore, it will be understood that any of the various insulating structures may be arranged in any suitable manner to form a heating sheet according to the invention. In one example, two sheets of an insulating material may be arranged so that their respective susceptor layers are facing away from each other. In another example, two sheets of an insulating material may be arranged so that their respective susceptor layers are facing towards each other. In still another example, multiple sheets of an insulating material may be arranged in a like manner and superposed. In a still further example, multiple sheets of various insulating materials are superposed in any other configuration as needed or desired for a particular application.

It will be recognized that each of the exemplary insulating materials depicted in FIGS. 2A-12 include a moisture-containing layer (e.g. paper) that is believed to release at least a portion of the vapor that inflates the expandable cells. However, it is contemplated that structures that are inflated without such moisture-containing layers also may be used in accordance with the invention.

Figure 13A:
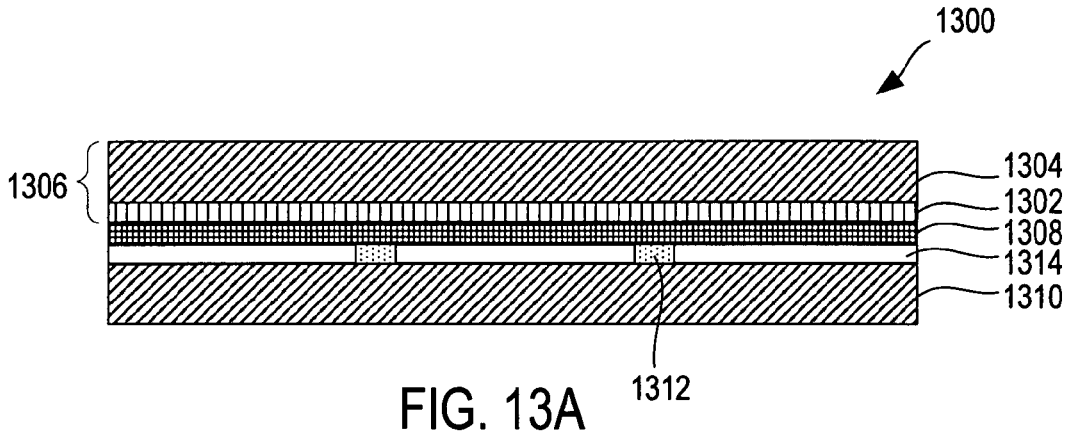
FIG. 13A is a schematic cross-sectional view of yet another exemplary microwave energy interactive insulating material that may be used in accordance with various aspects of the invention.

FIG. 13A illustrates one example of an expandable cell insulating material 1300 that inflates without the use of a moisture-containing layer, for example, paper. In this example, one or more reagents are used to generate a gas that expands the cells of the insulating material. For example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis (benzenesulphonylhydrazide), azodicarbonamide, and p-toluenesulfonylsemicarbazide. However, it will be understood that numerous other reagents and released gases are contemplated hereby.

Figure 13B:
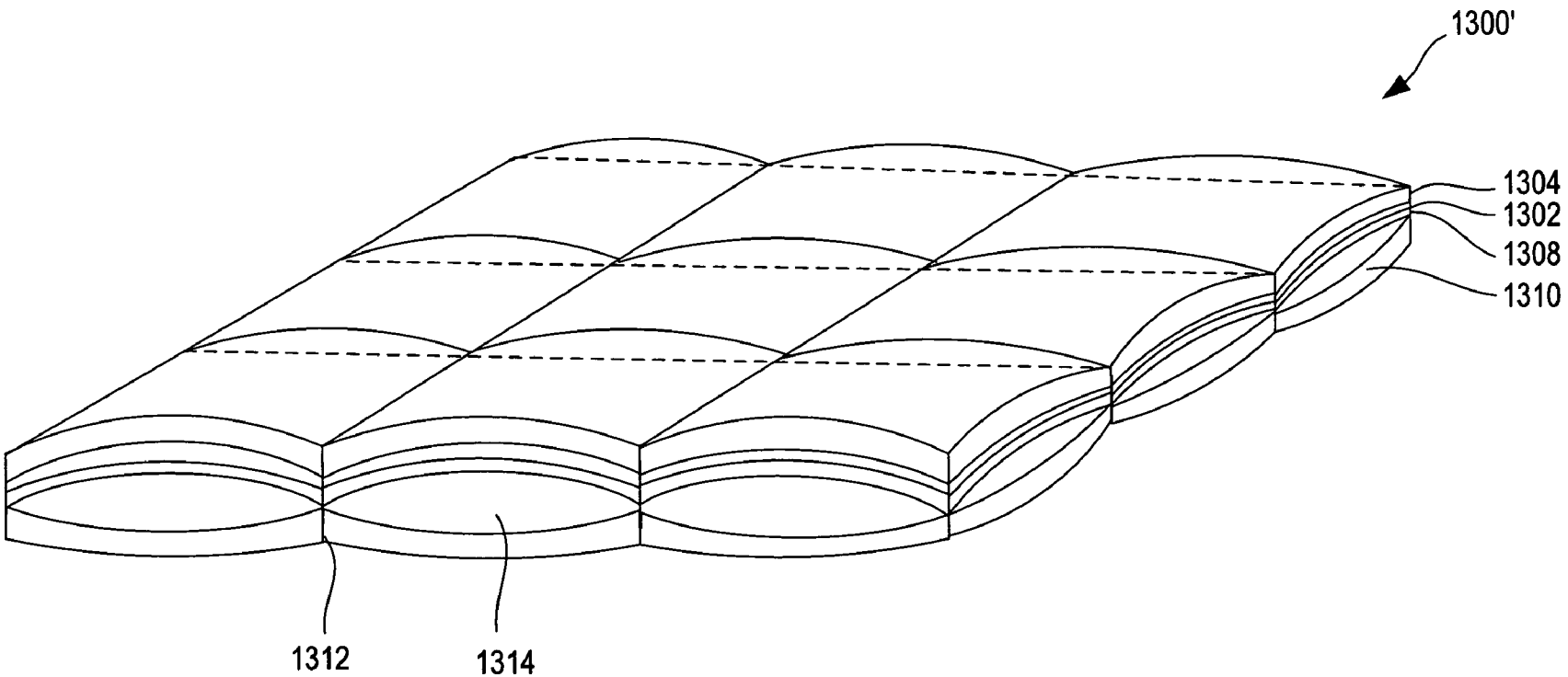
FIG. 13B is a schematic perspective view of the microwave energy interactive insulating material of FIG. 13A, after sufficient exposure to microwave energy.

In the example shown in FIG. 13A, a thin layer of microwave interactive material 1302 is supported on a first polymer film 1304 to form a susceptor film 1306. One or more reagents 1308, optionally within a coating, lie adjacent at least a portion of the layer of microwave interactive material 1302. The reagent 1308 coated susceptor film 1306 is joined to a second polymer film 1310 using a patterned adhesive 1312 or other material, or using thermal bonding, ultrasonic bonding, or any other suitable technique, such that closed cells 1314 (shown as a void) are formed in the material 1300. The microwave energy insulating material 1300 can be cut into a sheet 1316, as shown in FIG. 13B.

As discussed in connection with the other exemplary insulating materials, as the microwave interactive material 1302 heats upon impingement by microwave energy, water vapor or other gases are released from or generated by the reagent 1308. The resulting gas applies pressure on the susceptor film 1306 on one side and the second polymer film 1310 on the other side of the closed cells 1314. Each side of the material 1300 reacts simultaneously, but uniquely, to the heating and vapor expansion to form a pillowed or quilted insulating material 1316'. This expansion may occur within 1 to 15 seconds in an energized microwave oven, and in some instances, may occur within 2 to 10 seconds. Even without a paper or paperboard layer, the water vapor resulting from the reagent is sufficient both to inflate the expandable cells and to absorb any excess heat from the microwave energy interactive material. Such materials are described further in U.S. Patent Application Publication No. 20060278521A1, which is incorporated by reference herein in its entirety.

Typically, when microwave heating has ceased, the cells or quilts may deflate and return to a somewhat flattened state. However, if desired, the insulating material may comprise a durably expandable microwave energy interactive insulating material. As used herein, the term "durably expandable microwave energy interactive insulating material" or "durably expandable insulating material" refers to an insulating material that includes expandable cells that tend to remain at least partially, substantially, or completely inflated after exposure to microwave energy has been terminated. Such materials may be used to form multi-functional packages and other constructs that can be used to heat a food item, to provide a surface for safe and comfortable handling of the food item, and to contain the food item after heating. Thus, a durably expandable insulating material may be used to form a package or construct that facilitates storage, preparation, transportation, and consumption of a food item, even "on the go".

In one aspect, a substantial portion or number of the plurality of cells remain substantially expanded for at least about 1 minute after exposure to microwave energy has ceased. In another aspect, a substantial portion or number of the plurality of cells remain substantially expanded for at least about 5 minutes after exposure to microwave energy has ceased. In still another aspect, a substantial portion or number of the plurality of cells remain substantially expanded for at least about 10 minutes after exposure to microwave energy has ceased. In yet another aspect, a substantial portion or number of the plurality of cells remain substantially expanded for at least about 30 minutes after exposure to microwave energy has ceased. It will be understood that not all of the expandable cells in a particular construct or package must remain inflated for the insulating material to be considered to be "durable". Instead, only a sufficient number of cells must remain inflated to achieve the desired objective of the package or construct in which the material is used.

For example, where a durably expandable insulating material is used to form all or a portion of a package or construct for storing a food item, heating, browning, and/or crisping the food item in a microwave oven, removing it from the microwave oven, and removing it from the construct, only a sufficient number of cells need to remain at least partially inflated for the time required to heat, brown, and/or crisp the food item and remove it from the microwave oven after heating. In contrast, where a durably expandable insulating material is used to form all or a portion of a package or construct for storing a food item, heating, browning, and/or crisping the food item in a microwave oven, removing the food item from the microwave oven, and consuming the food item within the construct, a sufficient number of cells need to remain at least partially inflated for the time required to heat, brown, and/or crisp the food item, remove it from the microwave oven after heating, and transport the food item until the food item and/or construct has cooled to a surface temperature comfortable for contact with the hands of the user.

Any of the durably expandable insulating materials of the present invention may be formed at least partially from one or more barrier materials, for example, polymer films, that substantially reduce or prevent the transmission of oxygen, water vapor, or other gases from the expanded cells. Examples of such materials are described below. However, the use of other materials is contemplated hereby.

It will be understood that any of the microwave energy interactive insulating materials described herein or contemplated hereby may include an adhesive pattern or thermal bond pattern that is selected to enhance cooking of a particular food item. For example, where the food item is a larger item, the adhesive pattern may be selected to form substantially uniformly shaped expandable cells. Where the food item is a small item, the adhesive pattern may be selected to form a plurality of different sized cells to allow the individual items to be variably contacted on their various surfaces. While several examples are provided herein, it will be understood that numerous other patterns are contemplated hereby, and the pattern selected will depend on the heating, browning, crisping, and insulating needs of the particular food item.

Numerous materials may be suitable for use in the various heating sheets and other structures described herein and/or contemplated hereby.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively still, the microwave energy interactive material may comprise a suitable electroconductive, semiconductive, or non-conductive artificial dielectric or ferroelectric. Artificial dielectrics comprise conductive, subdivided material in a polymer or other suitable matrix or binder, and may include flakes of an electroconductive metal, for example, aluminum.

The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive structure, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 cc/m$^2$/day. In one aspect, the barrier film has an OTR of less than about 10 cc/m$^2$/day. In another aspect, the barrier film has an OTR of less than about 1 cc/m$^2$/day. In still another aspect, the barrier film has an OTR of less than about 0.5 cc/m$^2$/day. In yet another aspect, the barrier film has an OTR of less than about 0.1 cc/m$^2$/day.

The barrier film may have a water vapor transmission rate (WVTR) of less than about 100 g/m$^2$/day as measured using ASTM F1249. In one aspect, the barrier film has a WVTR of less than about 50 g/m$^2$/day. In another aspect, the barrier film has a WVTR of less than about 15 g/m$^2$/day. In yet another aspect, the barrier film has a WVTR of less than about 1 g/m$^2$/day. In still another aspect, the barrier film has a WVTR of less than about 0.1 g/m$^2$/day. In a still further aspect, the barrier film has a WVTR of less than about 0.05 g/m$^2$/day.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5,221,419; 5,213,902; 5,117,078; 5,039,364; 4,963,420; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The various heating sheets and other structures of the invention also may include one or more a dimensionally stable, moisture-containing, microwave energy transparent layers. For example, the heating sheet or other structures may include a paper or paper-based material generally having a basis weight of from about 15 to about 60 lbs/ream (lbs/3000 sq. ft.), for example, from about 20 to about 40 lbs/ream. In one particular example, the paper has a basis weight of about 25 lbs/ream. Where a somewhat less flexible heating sheet is desired, the heating sheet or other structures may include a paperboard material generally having a basis weight of from about 60 to about 330 lbs/ream, for example, from about 80 to about 140 lbs/ream, or from about 100 to about 150 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

If desired, any of the various heating sheets or other constructs of the invention may include one or more discontinuities or microwave energy transparent or inactive regions to prevent overheating or charring of the heating sheet, dimensionally stable disk, tray, or any other component proximate the heating sheet during the heating cycle. The inactive regions may be designed to be microwave inactive, for example, by forming these areas without a microwave energy interactive material, by removing microwave energy interactive material from these areas, or by deactivating the microwave energy interactive material in these areas.

Further still, one or more panels, portions of panels, or portions of the construct may be designed to be microwave energy transparent to ensure that the microwave energy is focused efficiently on the areas to be browned and/or crisped, rather than being lost to portions of the food item not intended to be browned and/or crisped or to the heating environment. For example, the peripheral edges of the heating sheet or other construct, or other areas not expected to be in contact with the food item may not include a microwave energy interactive material, or may include a microwave energy interactive material that has been deactivated.

It will be understood that with some combinations of elements and materials, the microwave interactive material or element may have a grey or silver color this is visually distinguishable from the substrate or the other components in the structure. However, in some instances, it may be desirable to provide a structure having a uniform color and/or appearance. Such a structure may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the structure with a silver or grey ink or other concealing color in a suitable pattern or as a solid color layer to mask or conceal the presence of the microwave interactive element, or any other suitable technique or combination thereof.

Various aspects of the present invention may be understood further by way of the following example, which is not to be construed as limiting in any manner.

EXAMPLE

The microwave browning and crisping performance of various materials was compared. A 10 inch Tony's Original thin crust pizza was heated for 7 minutes in a 1000 watt Panasonic microwave oven with a turntable. The details of the evaluation and results are set forth in Table 1.

TABLE 1

| Test | Sample | Description | Results |
|---|---|---|---|
| 1 | Susceptor | 0.016 in. thick SBS paperboard laminated 48 gauge metalized polyester film | Some browning and crisping; acceptable results |
| 2 | Insulating material | 25 lb./ream paper adhesively laminated to 48 gauge metallized polyester film on one side, clear 48 gauge polyester film adhesive laminated in a quilt pattern; includes one susceptor layer and one layer of expandable insulating cells | Sufficient browning and crisping; very good results |

TABLE 1-continued

| Test | Sample | Description | Results |
|---|---|---|---|
| 3 | Double insulating material | Two layers of insulating material, as described in Test 2; includes two susceptor layers and two layers of expandable insulating cells | Substantially uniform browning and crisping; excellent results |

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention as defined in the appended claims. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention. While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention as set forth in the appended claims.

What is claimed is:

1. A microwave energy interactive heating sheet comprising:

at least two plies of a microwave energy interactive insulating material arranged in a superposed, layered configuration, wherein each ply of microwave energy interactive insulating material includes a susceptor film comprising microwave energy interactive material supported on a first polymer film layer, a moisture-containing layer superposed with the microwave energy interactive material, and a second polymer film layer joined to the moisture-containing layer in a predetermined pattern, thereby defining a plurality of expandable insulating cells between the moisture-containing layer and the second polymer film layer, wherein at least some of the expandable insulating cells are configured to inflate when the microwave energy interactive heating sheet is exposed to microwave energy.

2. The microwave energy interactive heating sheet of claim 1, wherein the at least two plies are at least partially joined to one another.

3. The microwave energy interactive heating sheet of claim 1, wherein the at least two plies of microwave energy interactive insulating material includes a first ply and a second ply, and the first ply and the second ply are at least partially joined along respective peripheral edges of the first ply and the second ply to define a cavity for receiving a food item.

4. The microwave energy interactive heating sheet of claim 1, having a surface intended to be in contact with a food item, wherein the susceptor film of one of the plies is proximate the surface of the food item.

5. The microwave energy interactive heating sheet of claim 1, in combination with a dimensionally stable construct, wherein the dimensionally stable construct includes a first surface and a second surface opposite the first surface, the first surface is intended to be in contact with a food item, and the second surface is intended to be in contact with the microwave energy interactive heating sheet.

6. The microwave energy interactive heating sheet of claim 1, in combination with a food item and a dimensionally stable construct in a packaging arrangement, wherein the microwave energy interactive heating sheet overlies the food item, and the food item overlies the dimensionally stable construct.

7. The combination of claim 6, wherein information about the food item is printed on the microwave energy interactive heating sheet.

8. The combination of claim 6, wherein the microwave energy interactive heating sheet is in a folded configuration.

9. The microwave energy interactive heating sheet of claim 1, in combination with a food item and a dimensionally stable construct in a packaging arrangement, wherein the microwave energy interactive heating sheet is disposed between the food item and the dimensionally stable construct.

10. The microwave energy interactive heating sheet of claim 1, in combination with a food item and a dimensionally stable construct in a packaging arrangement, wherein the microwave energy interactive heating sheet is at least partially joined to the dimensionally stable construct.

11. The microwave energy interactive heating sheet of claim 1, in combination with a food item, wherein the food item has a periphery, and the microwave energy interactive heating sheet has a peripheral margin that extends beyond the periphery of the food item.

12. The combination of claim 11, wherein the periphery of the food item is desirably browned and/or crisped, and upon sufficient exposure to microwave energy, the peripheral margin of the heating sheet lofts upwardly around at least a portion of the periphery of the food item.

13. A microwave energy interactive heating sheet comprising:

at least two plies of microwave energy interactive insulating material arranged in a superposed, layered configuration, wherein each ply of microwave energy interactive insulating material includes a susceptor film comprising microwave energy interactive material supported on a first polymer film, a support layer joined to the microwave energy interactive material, the support layer comprising a material selected from the group consisting of paper, paperboard, and polymer film, and a second polymer film joined to the support layer such that the support layer is positioned between the microwave energy interactive material and the second polymer film, the second polymer film being selectively joined to the support layer to define at least one closed cell between the support layer and the second polymer film layer, wherein the closed cell is operative for inflating in response to sufficient exposure to microwave energy.

14. The microwave energy interactive heating sheet of claim 13, wherein the at least two plies are separate from one another.

15. The microwave energy interactive heating sheet of claim 13, wherein the at least two plies are at least partially joined to one another.

16. The microwave energy interactive heating sheet of claim 1, wherein the at least two plies of microwave energy interactive insulating material includes a first ply and a second ply, and the first ply and the second ply are at least partially joined along respective peripheral edges of the first ply and the second ply to define a cavity for receiving a food item.

17. The microwave energy interactive heating sheet of claim 16, wherein in a first configuration, the food item is positioned within the cavity, and in a second configuration, with the food item removed from the cavity, the first ply and second ply of microwave energy interactive insulating material are in a superposed relationship and the food item is positioned on the superposed first ply and second ply of microwave energy interactive insulating material.

18. The microwave energy interactive heating sheet of claim 13, in combination with a dimensionally stable construct, wherein the dimensionally stable construct includes a first surface and a second surface opposite the first surface, the first surface is for contacting a food item, and the second surface is for contacting the microwave energy interactive heating sheet.

19. The microwave energy interactive heating sheet of claim 13, in combination with a food item and a dimensionally stable construct in a packaging arrangement, wherein the microwave energy interactive heating sheet overlies the food item, and the food item overlies the dimensionally stable construct.

20. The combination of claim 19, wherein information about the food item is printed on the microwave energy interactive heating sheet.

21. The combination of claim 19, wherein the microwave energy interactive heating sheet is in a folded configuration.

22. The microwave energy interactive heating sheet of claim 13, in combination with a food item and a dimensionally stable construct in a packaging arrangement, wherein the microwave energy interactive heating sheet is disposed between the food item and the dimensionally stable construct.

23. The microwave energy interactive heating sheet of claim 13, in combination with a food item and a dimensionally stable construct in a packaging arrangement, wherein the microwave energy interactive heating sheet is at least partially joined to the dimensionally stable construct.

24. The microwave energy interactive heating sheet of claim 13, in combination with a food item, wherein the food item has a periphery, and the microwave energy interactive heating sheet has a peripheral margin that extends beyond the periphery of the food item.

25. The combination of claim 24, in combination with the food item, wherein the periphery of the food item is desirably browned and/or crisped, and upon sufficient exposure to microwave energy, the peripheral margin of the heating sheet is configured to loft upwardly around at least a portion of the periphery of the food item.

* * * * *